US008640513B2

(12) United States Patent
Goren et al.

(10) Patent No.: US 8,640,513 B2
(45) **Date of Patent: *Feb. 4, 2014**

(54) ELECTRONIC AND MANUAL LOCK ASSEMBLY

(75) Inventors: Ori Goren, Shoham (IL); Amir Katz, Bat-Heffer (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 79 days.

This patent is subject to a terminal disclaimer.

(21) Appl. No.: 13/166,153

(22) Filed: Jun. 22, 2011

(65) Prior Publication Data

US 2012/0324967 A1 Dec. 27, 2012

(51) Int. Cl.
*E05B 47/00* (2006.01)
*E05B 37/06* (2006.01)

(52) U.S. Cl.
USPC ..... 70/279.1; 70/21; 70/284; 70/285; 70/38 B; 340/5.2; 340/542

(58) Field of Classification Search
USPC ..... 70/21, 284, 285, 38 A–38 C, 275, 277, 70/279.1–283.1, 432, 434, 435; 340/5.2, 340/5.25, 5.22, 542, 5.54, 5.6
See application file for complete search history.

(56) References Cited

U.S. PATENT DOCUMENTS

| | | | | |
|---|---|---|---|---|
| 3,253,270 | A | 5/1966 | Downer | |
| 3,879,721 | A | 4/1975 | Yereance | |
| 3,993,987 | A | 11/1976 | Stevens | |
| 4,727,368 | A | 2/1988 | Larson et al. | |
| 4,751,830 | A | 6/1988 | Cheng | |
| 4,766,746 | A | 8/1988 | Henderson et al. | |
| 4,808,993 | A | 2/1989 | Clark | |
| 4,838,052 | A | 6/1989 | Williams et al. | |
| 4,964,023 | A | 10/1990 | Nishizawa et al. | |
| 4,988,987 | A * | 1/1991 | Barrett et al. | 340/5.28 |

(Continued)

FOREIGN PATENT DOCUMENTS

| | | |
|---|---|---|
| DE | 10056119 | 6/2002 |
| EP | 0 668 422 | 8/1995 |

(Continued)

OTHER PUBLICATIONS

Ryobi Tek4 4V Digital Key Lock Box. [online]. The Home Depot, 2010 [retrieved on Jul. 13, 2010]. Retrieved from the Internet: <URL: http://www.homedepot.com/webapp/wcs/stores/servlet/ProductDisplay?storeId=10051&pr...>.

*Primary Examiner* — Suzanne Barrett
(74) *Attorney, Agent, or Firm* — Pillsbury Winthrop Shaw Pittman LLP

(57) ABSTRACT

An electronic and manual lock assembly having a lock housing, a mechanical lock, an electric motor, and a shackle having a pair of legs. The shackle can be unlocked relative to the housing by having one leg pivotally connected with the housing and the other leg rotated out of the housing. The lock includes a first stop member that prevents one leg from being rotated out of the housing. The first stop member is moveable as a result of unlocking the mechanical lock. The lock includes a second stop member that prevents one of the legs from being rotated out of the lock housing and is moveable as a result of operating the electric motor. The first stop member and the second stop member are independently moveable by the mechanical lock and the electric motor.

29 Claims, 24 Drawing Sheets

(56) References Cited

U.S. PATENT DOCUMENTS

| | | | | |
|---|---|---|---|---|
| 5,337,503 | A | 8/1994 | Goby | |
| 5,337,588 | A * | 8/1994 | Chhatwal | 70/278.3 |
| 5,349,345 | A | 9/1994 | Vanderschel | |
| 5,460,020 | A | 10/1995 | Hungerford | |
| 5,587,702 | A * | 12/1996 | Chadfield | 340/542 |
| 5,661,457 | A | 8/1997 | Ghaffari et al. | |
| 5,664,113 | A | 9/1997 | Worger et al. | |
| 5,771,722 | A * | 6/1998 | DiVito et al. | 70/277 |
| 5,949,336 | A | 9/1999 | Deschenes et al. | |
| 5,969,613 | A | 10/1999 | Yeager et al. | |
| 6,005,489 | A | 12/1999 | Siegle et al. | |
| 6,020,827 | A | 2/2000 | Konrad et al. | |
| 6,046,558 | A * | 4/2000 | Larson et al. | 318/283 |
| 6,047,575 | A * | 4/2000 | Larson et al. | 70/278.1 |
| 6,064,306 | A | 5/2000 | Deschenes et al. | |
| 6,128,932 | A | 10/2000 | Mainetti et al. | |
| 6,133,649 | A | 10/2000 | Iwamoto et al. | |
| 6,188,320 | B1 | 2/2001 | Kolton et al. | |
| 6,226,839 | B1 | 5/2001 | Sayegh | |
| 6,232,870 | B1 | 5/2001 | Garber et al. | |
| 6,234,051 | B1 | 5/2001 | Bareggi | |
| 6,239,737 | B1 | 5/2001 | Black | |
| 6,326,890 | B1 | 12/2001 | Costa | |
| 6,337,618 | B1 * | 1/2002 | Craig et al. | 340/5.22 |
| 6,384,711 | B1 | 5/2002 | Cregger et al. | |
| 6,401,501 | B1 * | 6/2002 | Kajuch et al. | 70/25 |
| 6,442,983 | B1 | 9/2002 | Thomas et al. | |
| 6,525,433 | B1 | 2/2003 | Enoyoshi et al. | |
| 6,556,819 | B2 | 4/2003 | Irvin | |
| 6,567,003 | B2 | 5/2003 | Kolton et al. | |
| 6,568,720 | B1 | 5/2003 | Szablewski | |
| 6,598,433 | B1 | 7/2003 | Malvasio | |
| 6,600,418 | B2 | 7/2003 | Francis et al. | |
| 6,683,391 | B1 | 1/2004 | Enoyoshi et al. | |
| 6,718,806 | B2 | 4/2004 | Davis | |
| 6,761,051 | B1 * | 7/2004 | Tsai | 70/38 B |
| 6,804,578 | B1 | 10/2004 | Ghaffari | |
| 6,813,912 | B1 | 11/2004 | Ng et al. | |
| 6,822,553 | B1 | 11/2004 | Henderson et al. | |
| 6,845,279 | B1 | 1/2005 | Gilmore et al. | |
| 6,853,303 | B2 | 2/2005 | Chen et al. | |
| 6,933,847 | B2 | 8/2005 | Feibelman | |
| 6,964,183 | B2 * | 11/2005 | Keightley | 70/279.1 |
| 6,989,732 | B2 | 1/2006 | Fisher | |
| 6,989,749 | B2 | 1/2006 | Mohr | |
| 7,009,489 | B2 | 3/2006 | Fisher | |
| 7,021,092 | B2 * | 4/2006 | Loughlin et al. | 70/56 |
| 7,044,373 | B1 | 5/2006 | Garber et al. | |
| 7,086,258 | B2 | 8/2006 | Fisher et al. | |
| 7,119,686 | B2 | 10/2006 | Bertness et al. | |
| 7,123,149 | B2 | 10/2006 | Nowak et al. | |
| 7,129,841 | B2 | 10/2006 | Feibelman | |
| 7,151,979 | B2 | 12/2006 | Andersen et al. | |
| 7,159,422 | B1 * | 1/2007 | Misner et al. | 70/21 |
| 7,178,369 | B2 * | 2/2007 | Azzalin et al. | 70/50 |
| 7,209,041 | B2 | 4/2007 | Hines et al. | |
| 7,227,467 | B2 | 6/2007 | Feibelman | |
| 7,239,241 | B2 | 7/2007 | Claudatos et al. | |
| 7,243,963 | B2 | 7/2007 | De Lima Castro | |
| 7,245,221 | B2 | 7/2007 | Claudatos et al. | |
| 7,249,401 | B2 | 7/2007 | Copen et al. | |
| 7,253,736 | B2 | 8/2007 | Tethrake et al. | |
| 7,259,674 | B2 | 8/2007 | Marsilio et al. | |
| 7,278,341 | B1 | 10/2007 | Novin et al. | |
| 7,283,975 | B2 | 10/2007 | Broughton | |
| 7,298,240 | B2 | 11/2007 | Lamar | |
| 7,307,530 | B2 | 12/2007 | Fabian et al. | |
| 7,319,395 | B2 | 1/2008 | Puzio et al. | |
| 7,333,016 | B2 | 2/2008 | Ancel | |
| 7,334,443 | B2 * | 2/2008 | Meekma et al. | 70/278.7 |
| 7,336,181 | B2 | 2/2008 | Nowak et al. | |
| 7,339,477 | B2 | 3/2008 | Puzio et al. | |
| D567,128 | S | 4/2008 | Sayegh | |
| 7,363,782 | B1 * | 4/2008 | Misner et al. | 70/21 |
| 7,382,250 | B2 * | 6/2008 | Marcelle et al. | 340/542 |
| 7,391,326 | B2 | 6/2008 | Puzio et al. | |
| 7,397,375 | B2 | 7/2008 | Marsilio et al. | |
| 7,424,812 | B2 * | 9/2008 | Loughlin et al. | 70/56 |
| 7,429,910 | B2 | 9/2008 | Domenz et al. | |
| 7,434,426 | B2 * | 10/2008 | Loughlin et al. | 70/25 |
| 7,446,644 | B2 | 11/2008 | Schaffzin et al. | |
| 7,525,267 | B2 | 4/2009 | Angiuli et al. | |
| 7,595,733 | B2 | 9/2009 | Spagna | |
| 7,609,166 | B2 | 10/2009 | Forster et al. | |
| 7,626,501 | B2 | 12/2009 | Feibelman | |
| 7,683,758 | B2 | 3/2010 | Denison et al. | |
| 7,948,359 | B2 * | 5/2011 | Marcelle et al. | 340/5.64 |
| 8,146,391 | B2 * | 4/2012 | Loughlin et al. | 70/27 |
| 8,225,629 | B2 * | 7/2012 | Zuraski et al. | 70/21 |
| 2002/0008621 | A1 | 1/2002 | Barritz et al. | |
| 2002/0089434 | A1 | 7/2002 | Ghazarian | |
| 2002/0153418 | A1 | 10/2002 | Maloney | |
| 2002/0154014 | A1 | 10/2002 | Elston | |
| 2003/0102970 | A1 * | 6/2003 | Creel et al. | 340/568.1 |
| 2003/0160697 | A1 | 8/2003 | Sedon et al. | |
| 2003/0179075 | A1 * | 9/2003 | Greenman | 340/5.54 |
| 2004/0226325 | A1 * | 11/2004 | Ling | 70/63 |
| 2004/0255623 | A1 * | 12/2004 | Sun et al. | 70/38 A |
| 2005/0078006 | A1 | 4/2005 | Hutchins et al. | |
| 2005/0099262 | A1 * | 5/2005 | Childress et al. | 340/5.6 |
| 2005/0168320 | A1 * | 8/2005 | Henderson et al. | 340/5.25 |
| 2005/0200485 | A1 | 9/2005 | Connolly et al. | |
| 2005/0234778 | A1 | 10/2005 | Sperduti et al. | |
| 2006/0109118 | A1 | 5/2006 | Pelo et al. | |
| 2006/0144102 | A1 * | 7/2006 | Keightley | 70/279.1 |
| 2006/0179473 | A1 | 8/2006 | Innami et al. | |
| 2006/0202009 | A1 | 9/2006 | Austin | |
| 2006/0267575 | A1 | 11/2006 | Sampson et al. | |
| 2007/0018787 | A1 * | 1/2007 | Martinez de Velasco Cortina et al. | 340/5.61 |
| 2007/0200660 | A1 | 8/2007 | Endo et al. | |
| 2007/0219916 | A1 | 9/2007 | Lucas | |
| 2008/0088447 | A1 | 4/2008 | Flores et al. | |
| 2008/0115636 | A1 | 5/2008 | DeRose et al. | |
| 2008/0147529 | A1 | 6/2008 | Kreiner et al. | |
| 2008/0156047 | A1 * | 7/2008 | Sayegh | 70/57.1 |
| 2008/0177267 | A1 | 7/2008 | Sands et al. | |
| 2008/0266108 | A1 | 10/2008 | Teeter | |
| 2008/0290990 | A1 | 11/2008 | Schaffzin et al. | |
| 2008/0309458 | A1 | 12/2008 | Fisher | |
| 2008/0316035 | A1 | 12/2008 | Tuttle | |
| 2009/0282876 | A1 | 11/2009 | Zuraski et al. | |
| 2009/0298658 | A1 * | 12/2009 | Yeh | 483/14 |
| 2009/0320532 | A1 | 12/2009 | Bonato | |
| 2010/0295665 | A1 | 11/2010 | Landau et al. | |
| 2012/0011902 | A1 * | 1/2012 | Meekma | 70/25 |
| 2012/0266636 | A1 * | 10/2012 | Nave | 70/27 |

FOREIGN PATENT DOCUMENTS

| | | |
|---|---|---|
| EP | 1 205 885 | 5/2002 |
| EP | 1 371 797 | 12/2003 |
| EP | 1733112 | 12/2006 |
| EP | 2 261 446 | 12/2010 |
| WO | WO 00/61897 | 10/2000 |
| WO | WO 03/095773 | 11/2003 |
| WO | WO 2005/090721 | 9/2005 |

* cited by examiner

ELECTRONIC AND MANUAL LOCK ASSEMBLY

BACKGROUND OF THE INVENTION

Field of the Invention

The present invention relates to an electronic and manual lock assembly.

Electronic locks are used to secure a variety of objects. Electronic locks may be unlocked without requiring the use of a mechanical key. However, if power is no longer provided to the lock and/or the battery fails, the electronic lock cannot be unlocked and ceases to operate as intended.

SUMMARY

One aspect of the invention provides an electronic and manual lock assembly including a lock housing, a mechanical lock carried by the housing, an electric motor carried by the housing, and a shackle having a pair of legs. The shackle is configured to be unlocked relative to the housing by having one of the legs pivotally connected with the housing and the other of the legs rotated out of the housing. The lock also includes a first stop member operable to prevent one of the legs from being rotated out of the lock housing. The first stop member is moveable as a result of unlocking the mechanical lock to enable one of the legs to be rotated out of the housing. The lock also includes a second stop member operable to prevent one of the legs from being rotated out of the lock housing. The second stop member is moveable as a result of operating the electric motor to enable one of the legs to be rotated out of the housing. The first stop member and the second stop member are independently moveable by the mechanical lock and the electric motor.

Another aspect provides an electronic and manual lock assembly including a lock housing and a shackle having a pair of legs. The shackle is unlockable relative to the housing by having at least one of the legs being moved out of the lock housing. The lock also includes a controller having a memory configured to store unlock codes transmitted from at least one electronic key, and an electric motor carried by the housing and configured to be moveable by the controller to unlock the shackle relative to the housing based on the unlock codes received by the controller from the at least one electronic key. The lock further includes a mechanical lock carried by the lock housing and moveable by a mechanical key between a plurality of positions. Movement of the mechanical lock by the mechanical key to a first position of the plurality of positions enables the controller to add unlock codes to the memory and movement of the mechanical lock by the mechanical key to a second position of the plurality of positions unlocks the shackle relative to the housing.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION OF THE INVENTION

Figure 1:
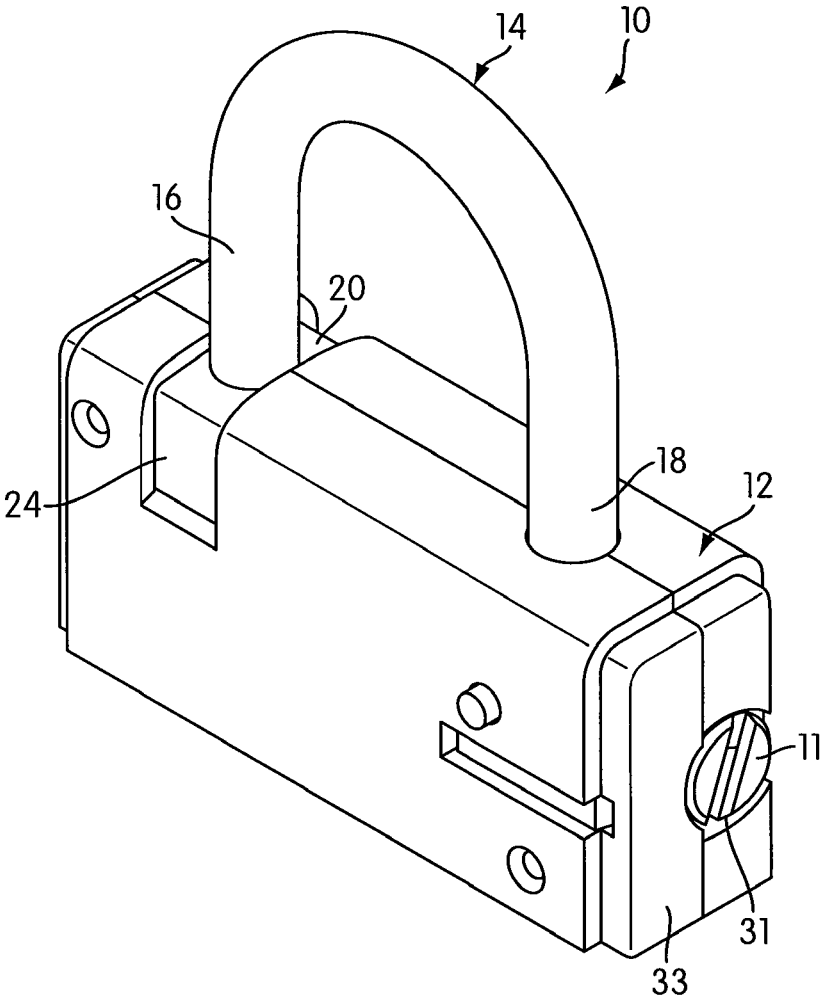
FIG. 1 is a perspective view of an electronic and manual lock assembly in accordance with an embodiment.

FIG. 1 shows an electronic and manual lock assembly 10 (also referred to herein as "lock 10" for simplicity) having a lock housing 12, a mechanical lock 11 carried by the housing 12, and an electric motor 13 (see FIG. 5) carried by the housing 12. As shown in FIG. 1, the lock 10 also includes a shackle 14 having a pair of legs 16, 18. The shackle 14 is configured to be unlocked relative to the housing 12 by having one of the legs pivotally connected with the housing 12 and the other of the legs 16, 18 rotated out of the housing 12. The lock 10 also includes a first stop member 20 operable to prevent one of the legs 16, 18 from being rotated out of the lock housing 12. The first stop member is moveable as a result of unlocking the mechanical lock 11 (see FIG. 5 for better view) to enable one of the legs 16, 18 to be rotated out of the housing 12. Referring back to FIG. 1, the lock 10 also includes a second stop member 24 operable to prevent one of the legs 16, 18 from being rotated out of the lock housing 12. The second stop member 24 is moveable as a result of operating the electric motor 13 (see FIG. 5) to enable one of the legs 16, 18 to be rotated out of the housing 12. The first stop member 20 and the second stop member 24 are independently moveable by the mechanical lock 11 and the motor 13, respectively. In one embodiment, the mechanical lock 11 may be a key cylinder. However, it should be appreciated that other types of mechanical locks (e.g., combination locks or other types of locks) may be used in other embodiments.

Figure 2:
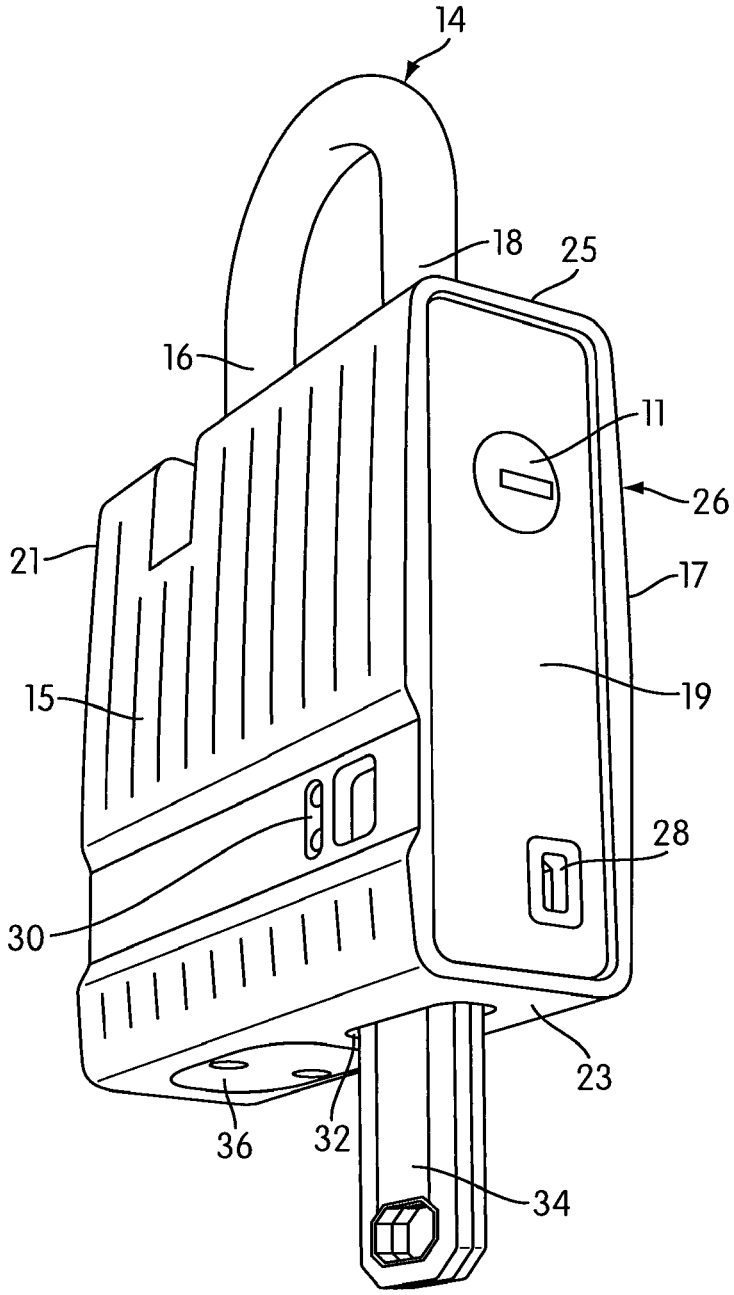
FIG. 2 is a perspective view of the electronic and manual lock assembly in accordance with an embodiment.

As shown in FIG. 2, an outer casing or outer housing 26 may be provided on the outside of the lock housing 12 and may be fabricated using metal materials, plastic materials, other materials, or a combination thereof. The lock housing 12 may also be made of metal materials, plastic materials, other materials, or a combination thereof. In some embodiments, the outer housing 26 and the lock housing 12 may be the same structure rather than two separate structures. For example, it should be appreciated that the lock housing 12 may replace the outer housing 26 and may enclose all the components of the lock 10 within the lock housing 12. Furthermore, the lock housing 12 may be an integrally molded structure or may be defined by separate pieces connected together to form the lock housing 12. Similarly, the outer housing 26 may be an integrally molded structure or may be defined by separate pieces connected to form the outer housing 26.

In the embodiment of FIG. 2, the lock 10 includes a front side 15, a rear side 17, a right side 19, a left side 21, a bottom side 23, and a top side 25. In the embodiment shown in FIG. 2, the lock 10 is provided with a port 28, which may be an universal serial bus (USB) port, to enable the lock 10 to be connected to a personal computer 29 (see FIG. 4), laptop computer, or other electronic devices to enable communication therewith. A light arrangement 30, which may be LED lights in some embodiments, may be provided on the lock 10 to communicate the status of the lock 10. In one embodiment, the lights 30 may include a red LED light 27A (see FIG. 16) and a green LED light 27B (see FIG. 16). A slot 32 may also be formed in the lock 10, the slot 32 being constructed and arranged to enable an electronic key 34 to be inserted therein. In some embodiments, the electronic key 34 may include a passive RFID device that includes an RFID transmitter, and may be similarly constructed as the electronic keys described in U.S. patent application Ser. No. 12/785,249, which is incorporated herein in its entirety. In one embodiment, the electronic key 34 is a short range passive RFID device capable of transmitting at, just for example, 125 kHZ. The electronic key 34 may be configured to transmit RFID signals that include unlock codes to the lock 10, which will be described in more detail below. It is contemplated that other methods of communications may be used, such as satellite signals, personal area networks (IrDA, Bluetooth, UWB, Z-Wave, and ZigBee).

The mechanical lock 11 may be constructed and arranged to receive a mechanical key 35 (see FIG. 8) that is constructed and arranged to move the mechanical lock 11 to a plurality of positions. A removable battery cover 36 may be provided on the housing 26 to retain batteries 38 (see FIG. 3) within the housing 26. In one embodiment, the batteries 38 may be lithium batteries. It should be appreciated, however, that power may be provided to the lock 10 in other ways. Just for example, the lock 10 may be constructed and arranged to connect to an AC outlet or power may be transmitted wirelessly to the lock 10. It is contemplated that a plurality of mechanical keys 35 and electronic keys 34 may be used with the lock 10. The electronic keys 34 may be configured to transmit signals having different unlock codes from one another.

Figure 3:
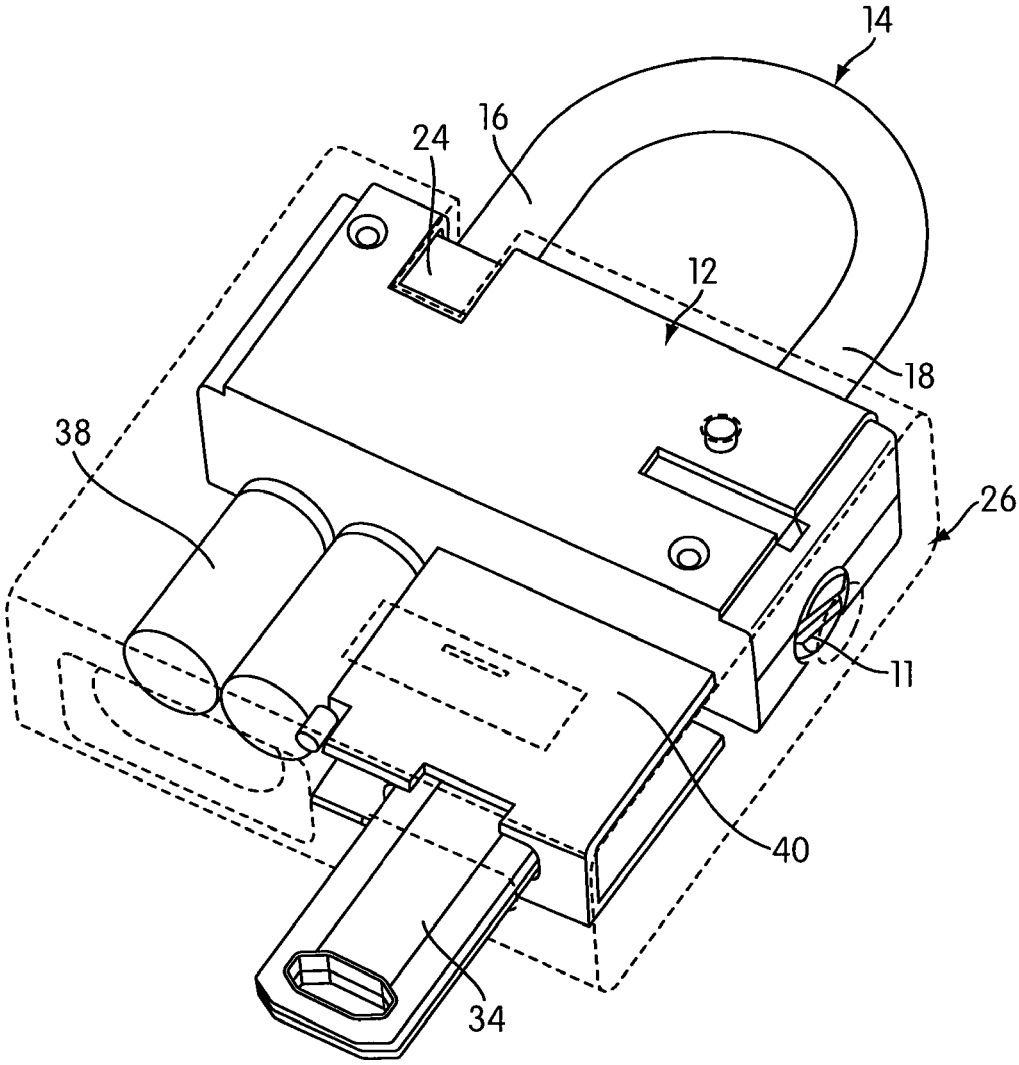
FIG. 3 is a perspective view of the electronic and manual lock assembly with an outer housing shown in dotted lines to better show the electronic and manual lock assembly components enclosed therein in accordance with an embodiment.

FIG. 3 shows an embodiment of the lock 10 with the outer housing 26 shown in a transparent manner to enable better view of the components enclosed therein. In this embodiment, the lock housing 12 is enclosed within the outer housing 26. A controller 40 constructed and arranged to be in communication with the motor 13 is also provided within the outer housing 26.

Figure 4:
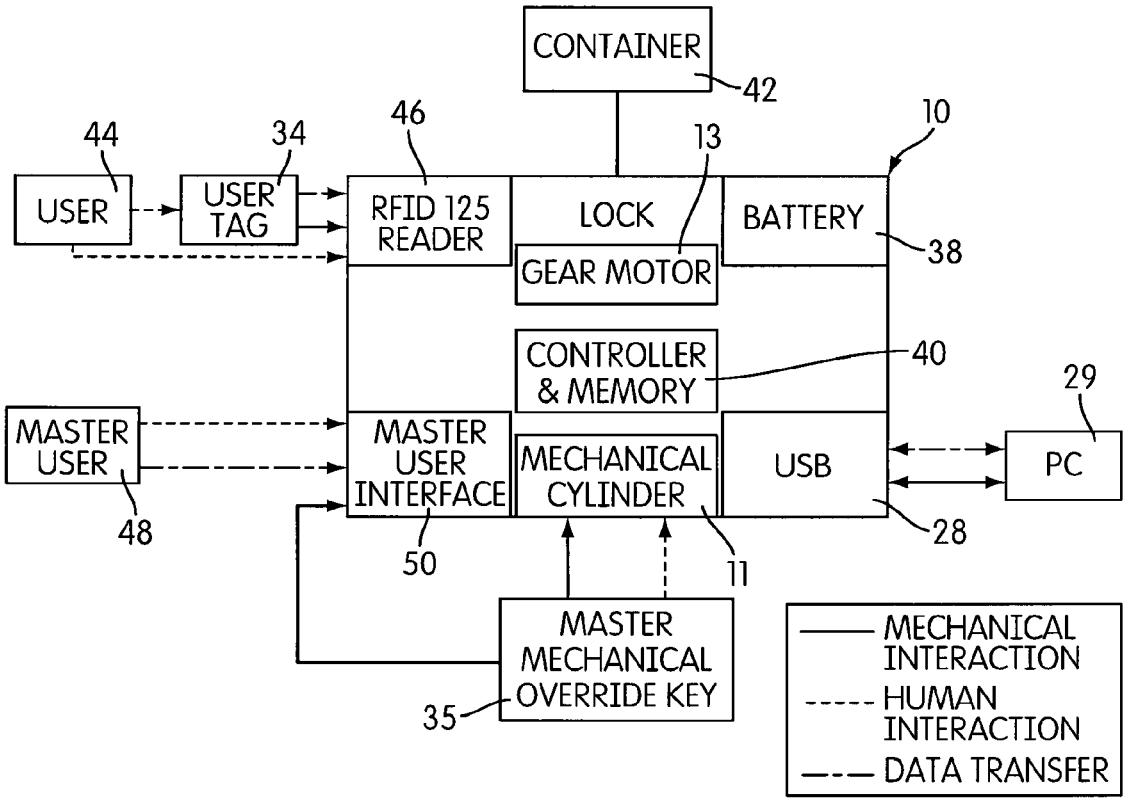
FIG. 4 is a schematic view of components of the electronic and manual lock assembly and keys used with the electronic and manual lock assembly in accordance with an embodiment.

FIG. 4 shows a schematic drawing of various components of the lock 10. The lock 10 may be used to lock a container 42. A user 44 may be associated with an electronic key 34 to unlock/lock the lock 10. The user 44 may be a worker at a worksite or anyone who may perform limited operations on the lock 10 (e.g., unlocking/locking the lock 10). The unlock codes transmitted by the electronic key 34 may be associated with user identification information that is unique to each user 44. It should be appreciated that in some embodiments, a plurality of users 44 may be associated with one electronic key 34, one user 44 may be associated with a plurality of electronic keys 34, or each electronic key 34 may be associated with one user 44. As mentioned above, the electronic key 34 may be configured to transmit RFID signals or other signals to the lock 10. The lock 10 may include a reader, such as an RFID reader 46, that is constructed and arranged to receive the RFID signals from the electronic key 34. The unlock codes may then be transmitted to the controller 40. In one embodiment, the RFID reader 46 may include a microprocessor, a transmitter for transmitting radio frequency signals, and a receiver for receiving radio frequency signals. The reader 46 may include an active reader and/or a passive reader. Therefore, the reader 46 as described herein may represent multiple readers, such as any number or combination of passive or active readers. In embodiments where the electronic key 34 includes passive RFID devices, the RFID devices in the electronic keys 34 may be powered by signals transmitted from the RFID reader 46. In some embodiments, the electronic keys 34 may include active RFID devices that have its own power supply (e.g., a battery). The RFID reader 46 may be configured to communicate with the controller 40. The controller 40 and the RFID reader 46 may be integral, or may be separate units that are connected to each other. Thus, the unlock codes may be transmitted directly or indirectly to the controller 40. The controller 40 may include or may be connected to memory configured to store unlock codes, statuses of the lock 10, history/usage data of the lock 10, and/or other information. The information may be stored in databases in the memory. In some embodiments, the databases may store up to 1,000 events and 50 unlock codes. The events may indicate the history or status of the lock 10. Just for example, the events may indicate "unlock," "lock", "pairing", "delete", lock off," or "lock on." As used herein "pairing" refers to the pairing of the electronic key 34 with the lock 10. That is, the unlock code or user identification information associated with the electronic key 34 is added to the memory of the lock 10 such that the lock 10 may recognize the electronic key 34 as an authorized key having an authorized unlock code that enables unlocking/locking of the lock 10. As used herein, the terms "authorized unlock code" refers to an unlock code that is stored in the memory of the lock 10 and that is associated with a user 44 having authorization to unlock the lock 10. The "delete" event refers to the deletion of the unlock code or user identification information associated with an electronic key 34 from the memory of the lock 10 such that the electronic key 34 may no longer enable unlocking/locking of the lock 10. The events may be stored with the identification information of the users 44 and/or master users 48 that performed the actions and may also include the time of the event. The USB port 28 enables the lock 10 to be connected to a personal computer (PC) 29 or other external devices to enable communication therebetween.

As mentioned above, the mechanical lock 11 may be constructed and arranged to interact with the mechanical key 35. The mechanical key 35 may be associated with a master user 48. The master users 48 may be a manager at worksite or any user that is given more privileges than the users 44. In some embodiments, all of the operations associated with the lock 10, including the "pairing" and "delete" actions of the lock 10, may only be performed by the master users 48. In such embodiments, the users 44 may only unlock or lock the lock 10 and remove and replace the batteries 38.

It should be appreciated that in some embodiments, a plurality of master users 48 may be associated with one mechanical key 35, one master user 48 may be associated with a plurality of mechanical keys 35, or each mechanical key 35 may be associated with one master user 48. The master user 48 may interact with the lock 10 using the mechanical key 35 and a master user interface 50. The master user 48 may also use an electronic key 34 to lock or unlock the lock 10. The master user 48 may perform more operations using the lock 10 than the user 44, which will be described in more detail below. In one embodiment, the position of the mechanical lock 11 may be communicated to the controller 40 for processing, which will also be described in more detail below. The master user interface 50 may include a button 52 (see FIG. 16), a keypad (not shown), the light arrangement 30, or other devices that the master user 48 may use to input information into the lock 10 or receive information from the lock. In one embodiment, the motor 13 may also be operatively connected to the controller 40 so that the motor 13 and the controller 40 are in communication with each other and the controller 40 may drive the motor 13 to unlock/lock the lock 10.

Figure 5:
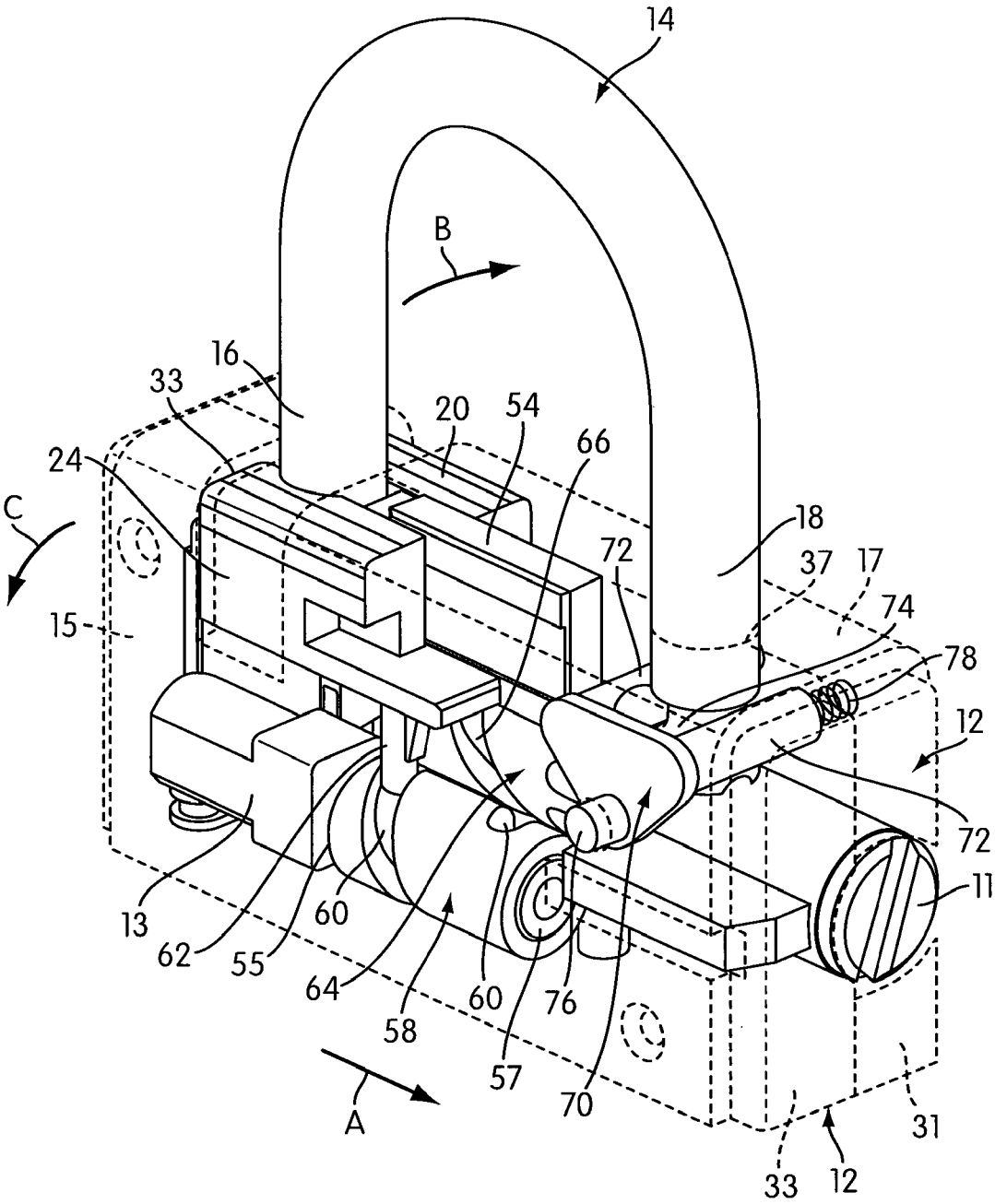
FIG. 5 is a perspective view of a portion of the electronic and manual lock assembly in the locked position with a lock housing shown in dotted lines to better show the electronic and manual lock assembly components enclosed therein in accordance with an embodiment.

FIG. 5 shows an embodiment of the lock 10 with the lock housing 12 shown in a transparent manner to better show the components enclosed therein. In this embodiment, the lock 10 is in a locked position wherein rotation of the first leg 16 out of the lock housing 12 is prevented. The lock housing 12 is provided with a first opening 33 such that at least portions of the first and second member 20, 24 are exposed. The first leg 16 of the shackle 14 is inserted through the opening 33 into the lock housing 12. A second opening 37 may formed on the lock housing 12 through which the second leg 18 extends into the lock housing 12.

In this embodiment, the first stop member 20 takes the form of a slideable panel and the second stop member 24 also takes the form of a slideable panel. The first stop member 20 and the second stop member 24 are slideable in the direction of A and in the direction opposite that of A to move the lock 10 between the unlocked and locked position, respectively. In the locked position, rotation of the first leg 16 from the lock housing 12 is prevented, and in the unlocked position, rotation of the first leg 16 from the lock housing 12 is permitted. In this embodiment, the lock 10 may be in the unlocked position when either one or both of the first and second stop members 20, 24 are moved in the direction of A to enable rotation of the first leg 16 from the lock housing 12. In other embodiments, however, the unlocked position may be defined by any position of the first and stop member 20, 24 that enable rotation or movement of either one or both of the legs 16, 18 from the lock housing 12.

In this embodiment, the second stop member 24 is located closer to the front side 15 than the first stop member 20, and the first stop member 20 is located closer to the rear side 17 than the second stop member 24. Furthermore, the lock housing 12 may be defined by a first portion 31 (see also FIG. 1) and a second portion 33 (see also FIG. 1). In one embodiment, the first stop member 20 is located in the first portion 31 and the second stop member 24 is located in the second portion 33. The first and stop members 20, 24 are located closer to the left side 21 than the right side 19 of the lock 10. Accordingly, in this embodiment, the first and second stop member 20, 24 are constructed and arranged to selectively prevent the first leg 16 from being rotated out of the lock housing 12. That is, the first stop member 20 prevents the first leg 16 from being rotated out of the lock housing 12 in the direction of B, and the second stop member 24 prevents the first leg 16 from being rotated out of the lock housing 12 in the direction of C. It should be appreciated, however, that the first and second stop members 20, 24 may be located elsewhere on the lock 10, and the first and second stop member 20, 24 may be constructed and arranged to selectively prevent the second leg 18 from being rotated out of the lock housing 12 in other embodiments.

The first and second stop members 20, 24 may be separated by a fixed separation panel 54 located therebetween such that the first and second stop members 20, 24 may independently slide relative to the separation panel 54. The second stop member 24 may include an extension or protrusion 56 (see FIG. 10) constructed and arranged to be received in a notch 58A (see FIG. 10) formed in the first leg 16 of the shackle 14 when the lock 10 is in the locked position (see FIG. 5). The first stop member 20 may also be provided with a similar protrusion (obstructed from view in FIG. 10) that is constructed and arranged to be received in a notch 58B (see FIG. 10) formed in the first leg 16 of the shackle 14 when the lock 10 is in the locked position.

Referring back to FIG. 5, the motor 13 may be operatively connected to a guide structure 58. In this embodiment, the guide structure 58 is a cylindrical structure having a first end 55, a second end 57, and a groove 60 formed on the outer surface thereof between the first end 55 and the second end 58. The first end 55 may be connected to the motor 13. The groove 60 may be in a spiral form along the outer surface of the guide structure 58 and may be constructed and arranged to receive at least a portion of an extension 62 of the second stop member 24. The mechanical lock 11 may also be operatively connected to a guide structure 64 having a first end 65 (see FIG. 8), a second end 67 (see FIG. 8), and a groove 66 formed on the outer surface thereof between the first end 65 and the second end 67. The groove 66 may also be in a spiral form along the outer surface of the guide structure 64 and may be constructed and arranged to receive at least a portion of an extension 68 (see FIG. 11) of the first lock member 20. The guide structures 58, 64 may have the same configuration or may have different configurations. It should also be appreciated that the guide structures 58, 64 may have various configurations in other embodiments and are not limited to the examples described above, and may not be necessary in some embodiments.

Also shown in FIG. 5 is a retaining structure 70 that is constructed and arranged to pivotally retain the second leg 18 within the lock housing 12. Accordingly, the second leg 18 remains in the lock housing 12 regardless of whether the lock 10 is in the unlocked or locked position. The retaining structure 70 includes a pair of legs 72 that are constructed and arranged to be received in a circumferential groove 74 formed in the second leg 18. Each of the legs 72 may include a recess 73 (see FIG. 14*a*) formed therein. Accordingly, the groove 74 and the pair of legs 72 enable pivotal movement of the second leg 18 during rotation of the first leg 16 of the shackle 14 out of the lock housing 12 when the lock 10 is in the unlocked position. The pair of legs 72 may each be provided biasing members 78, taking the form of compression springs in this embodiment, at an end thereof. The biasing members 78 may be in contact with a portion of the locking housing 12. The retaining structure 70 may also be provided with an actuating portion 76. The actuating portion 76 may be actuated to move the retaining structure 70 towards the rear side 17 of the lock 10 against the bias of the biasing members 78. Operation of the retaining structure 70 will be described in more detail later.

Figure 6:
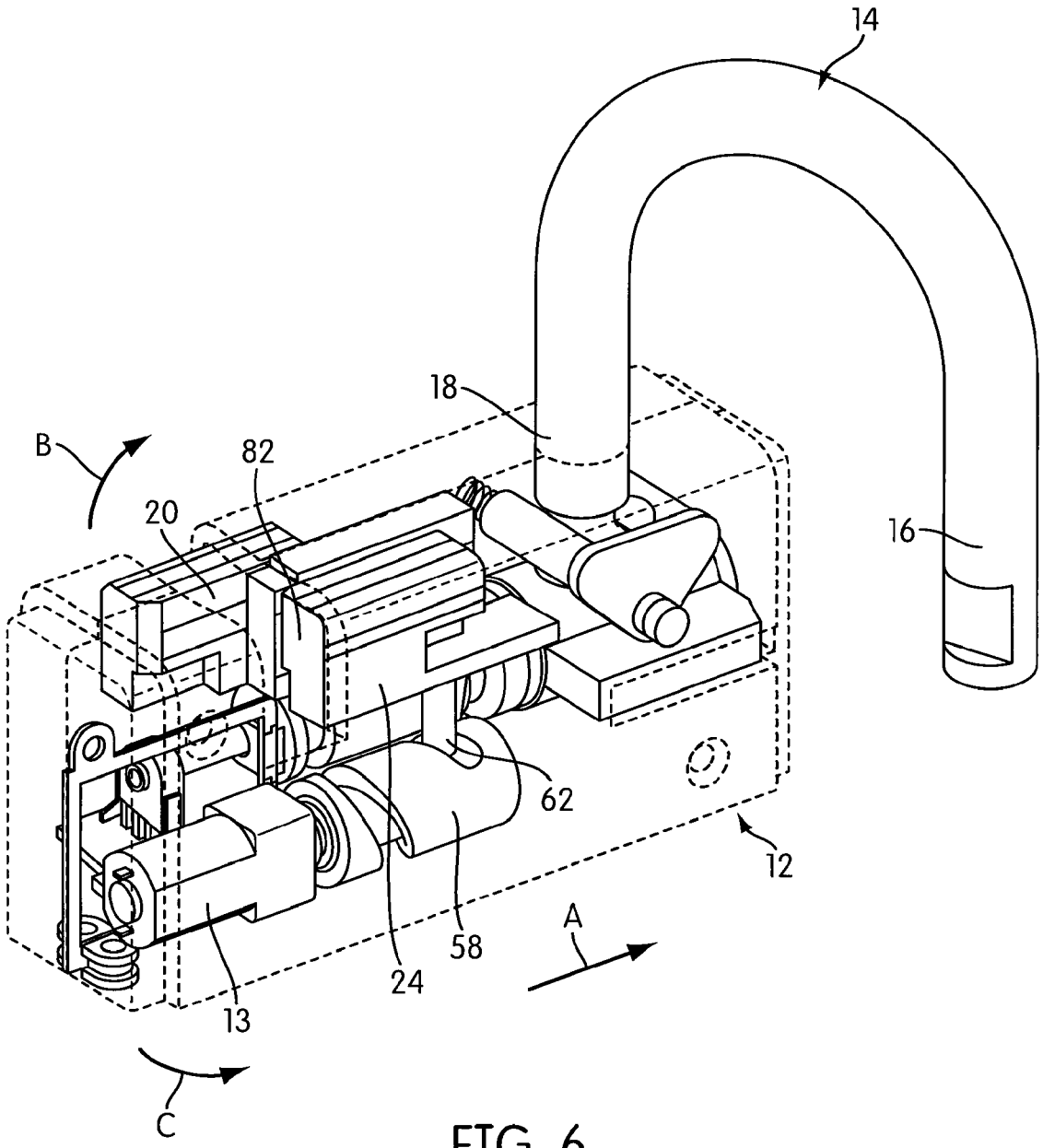
FIG. 6 is a perspective view of a portion of the electronic and manual lock assembly in the unlocked position with the lock housing shown in dotted lines to better show the electronic and manual lock assembly components enclosed therein in accordance with an embodiment.

FIG. 6 shows the lock 10 in the unlocked position with the lock housing 12 shown in a transparent manner to better show the components enclosed therein. In this Figure, the second stop member 24 is moved in the direction of A using the motor 13 and the guide structure 58 to unlock the lock 10 and to enable the first leg 16 to be rotated out of the lock housing 12. When the second stop member 24 is moved in the direction of A, an opening 82 in the lock housing 12 is accessible so that the first leg 16 may be rotated in the direction of C through the opening 82. In this Figure, the second stop member 24 prevents rotation of the first leg 16 in the direction of B.

Figure 7A:
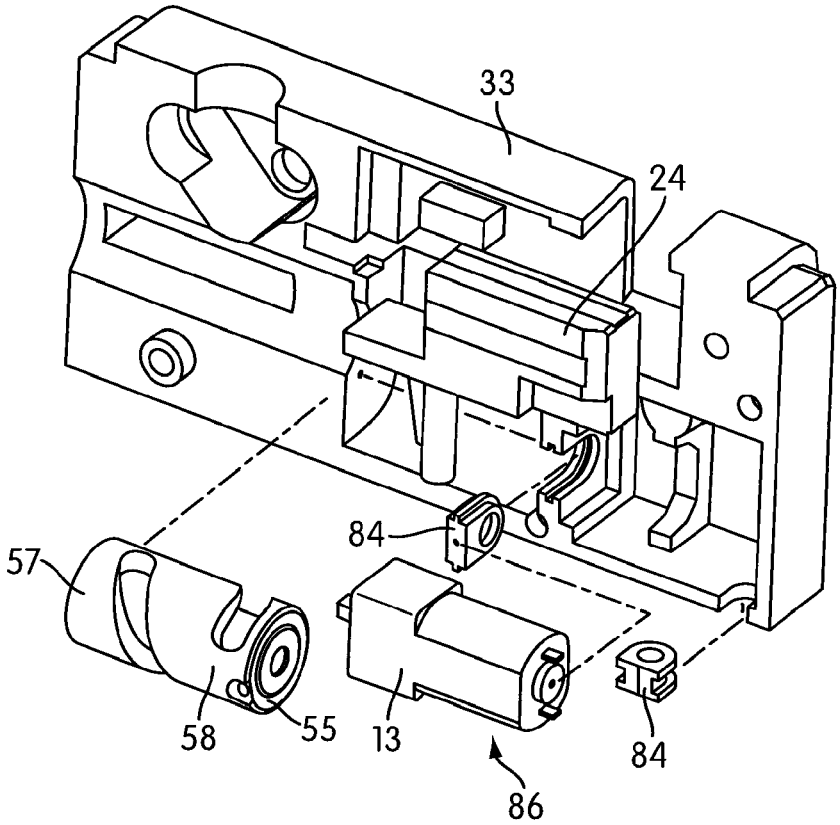
FIG. 7*a* is an exploded view of a portion of an electronic assembly of the electronic and manual lock assembly in accordance with an embodiment.
Figure 7B:
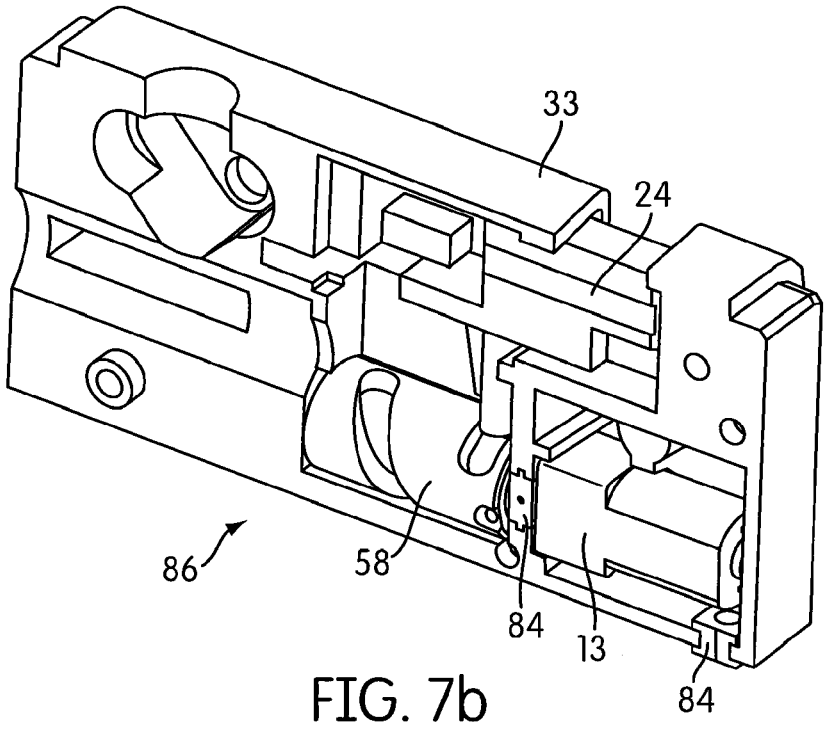
FIG. 7*b* shows a portion of the electronic assembly in the lock housing in accordance with an embodiment

FIGS. 7*a*-7*b* show components that enable the second stop member 24 to be moved to unlock the lock 10. FIG. 7 is an exploded view of some of the components that move the second stop member 24 to lock/unlock the lock 10. As shown in FIGS. 7*a*-7*b*, the second stop member 24, the guide structure 58, and the motor 13 may be received in the second portion 33 of the lock housing 12. Support structures 84 may be provided to help retain and guide electric wires or other components of the motor 13. Accordingly, the second stop member 24 and components that enable movement of the second stop member 24 may define an electronic assembly 86 of the lock 10.

Figure 8:
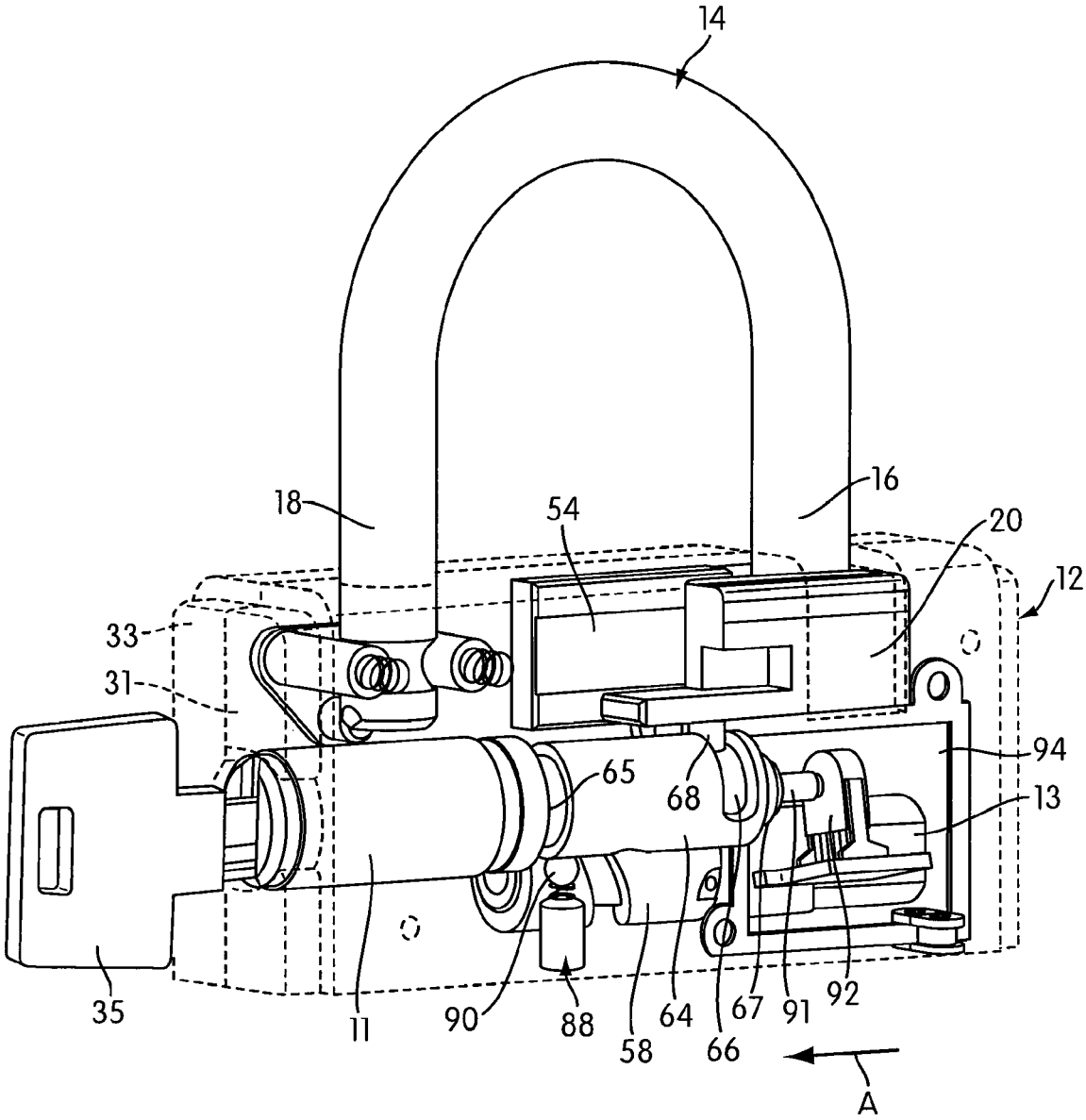
FIG. 8 is a perspective view of a portion of the electronic and manual lock assembly in the locked position with the lock housing shown in dotted lines to better show the electronic and manual lock assembly components enclosed therein in accordance with an embodiment.

FIG. 8 shows the components of the lock 10 located in the first portion 31 of the lock housing 12 in more detail, with the lock housing 12 shown in a transparent manner so as to better show the components enclosed therein. In this embodiment, the mechanical lock 11 is connected to the first end 65 of the guide structure 64 such that rotation of the mechanical lock 11 by the mechanical key 35 effects rotation of the guide structure 64. In this embodiment, the guide structure 64 interacts with an indicator 88 having a spring-loaded ball 90. The spring loaded ball 90 is constructed and arranged to be received in a detent (obstructed from view) formed in the guide structure 64 during rotation of the mechanical lock 11. Accordingly, rotation of the guide structure 64 effects the movement of the spring loaded ball 90 and enables the indicator 88 to indicate to the master user 48 during operation of the mechanical key 35 that a selected position has been reached. For example, in one embodiment, the indicator 88 may emit a "click" when a selected position has been reached due to the interaction between the spring loaded ball 90 and the guide structure 64. The guide structure 64 may also connect the mechanical lock 11 to an encoder 92. The guide structure 64 may include an extension 91 constructed and arranged to connect to the encoder 92 such that movement of the guide structure 64 by the mechanical lock 11 also moves the encoder 92. The encoder 92 may be in communication with the controller 40 and configured to send electric signals to the controller 40 indicating the movement of the mechanical lock 11 and/or the angular position of the mechanical key 35 within its axis of rotation in the mechanical lock 11. The movement of the mechanical lock 11 by the mechanical key 11 may effect electric signals to be sent by the encoder 92 to the controller 40, the electric signals being associated with operations that the controller 40 is programmed to perform. Thus, the angular position of the mechanical key 35 within the mechanical lock 11 may indicate the operation to be performed, which will be described in more detail later.

The encoder 92 may be an electromechanical device that converts the angular position or motion of the mechanical lock 11 and the guide structure 64 to an analog or digital code. The encoder 92 may be an incremental encoder, although in other embodiments, the encoder 92 may be an absolute encoder. The encoder 92 may be coupled to the guide structure 64 such that rotation of the guide structure 64 by the mechanical lock 11 also rotates the encoder 92. In embodiments where the encoder 92 is an incremental encoder, the output of the encoder 92 provides information about the motion of the shaft which is processed by the controller 40. In embodiments where the encoder 92 is an absolute encoder, the output of the encoder 92 may indicate the current position of the mechanical lock 11 and the guide structure 64. In some embodiments, the encoder 92 may produce two outputs that are 90 degrees out of phase and these output signal are then decoded by the controller 40 to produce a count up pulse or a count down pulse to determine the position and/or motion of the mechanical lock 11 and the guide structure 64. It should be appreciated that other type of sensors or devices may be used to determine the movement or position of the mechanical lock 11 in other embodiments.

Figure 9A:
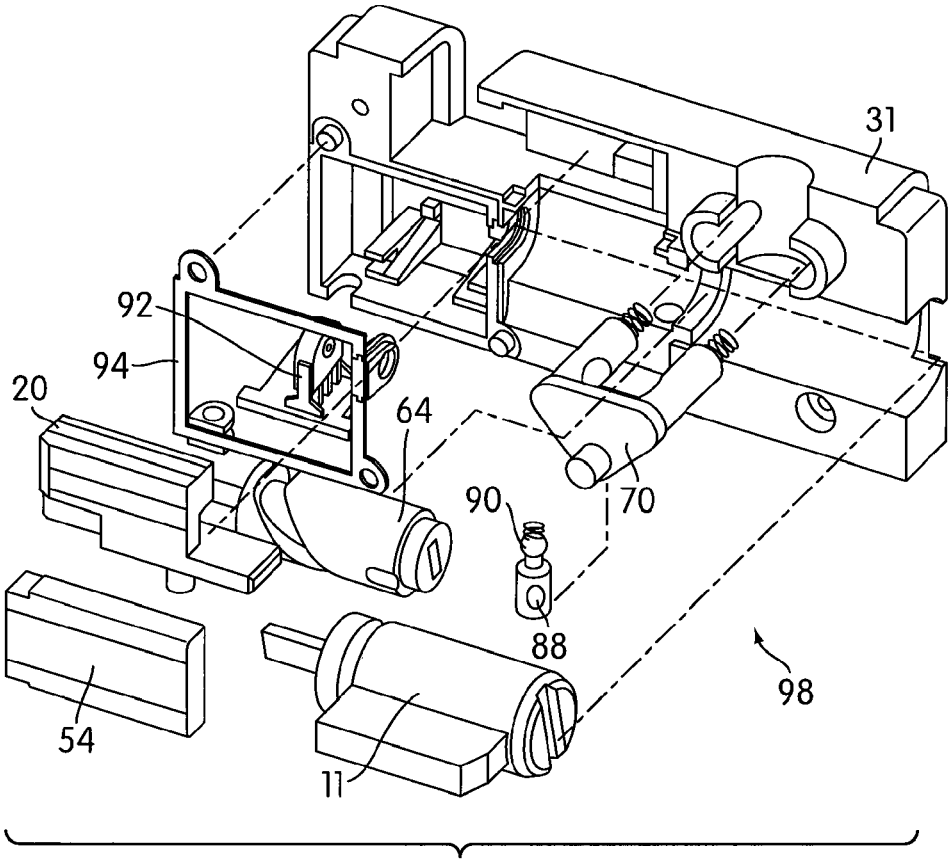
FIG. 9*a* is an exploded view of a portion of a mechanical assembly of the electronic and manual lock assembly in accordance with an embodiment.
Figure 9B:
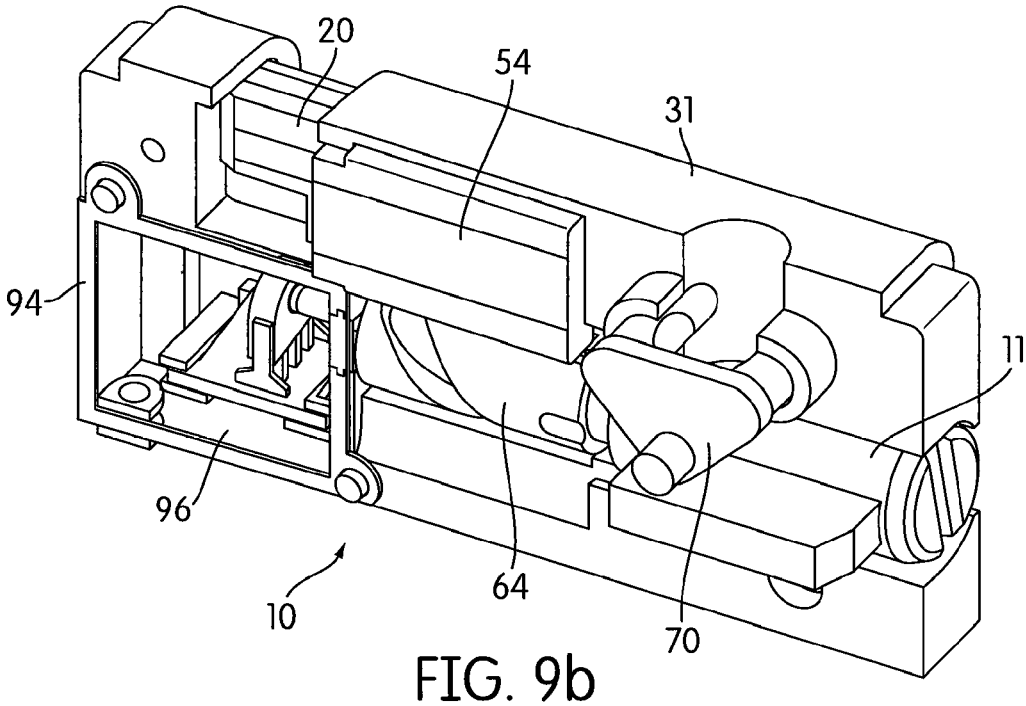
FIG. 9*b* shows a portion of the electronic assembly in the lock housing in accordance with an embodiment.

FIG. 9*a* shows components of the lock 10 used to move the first stop member 20 to lock/unlock the lock 10. These components may define a mechanical assembly 98 of the lock 10 and may be housed in the first portion 31 of the lock housing 12 (see FIG. 9*b*). A support structure 94 may be provided to help seal the motor 13 and the encoder 92 within a compartment 96 in the first portion 31 of the lock housing 12 to protect the motor 13 and the encoder 92 from dust and/or moisture. The mechanical assembly 98 of the lock 10 enables the unlocking of the lock 10 without the use of any electric components of the lock 10. As such, when the batteries 38 no longer have power or power is no longer provided to the lock 10, the lock 10 may still be unlocked using the mechanical assembly 98, which may be referred to as a "mechanical override" feature. That is, the mechanical key 35 may still be used to unlock/lock the lock 10 when the electronic key 34 is no longer capable of unlocking/locking the lock 10.

Figure 10:
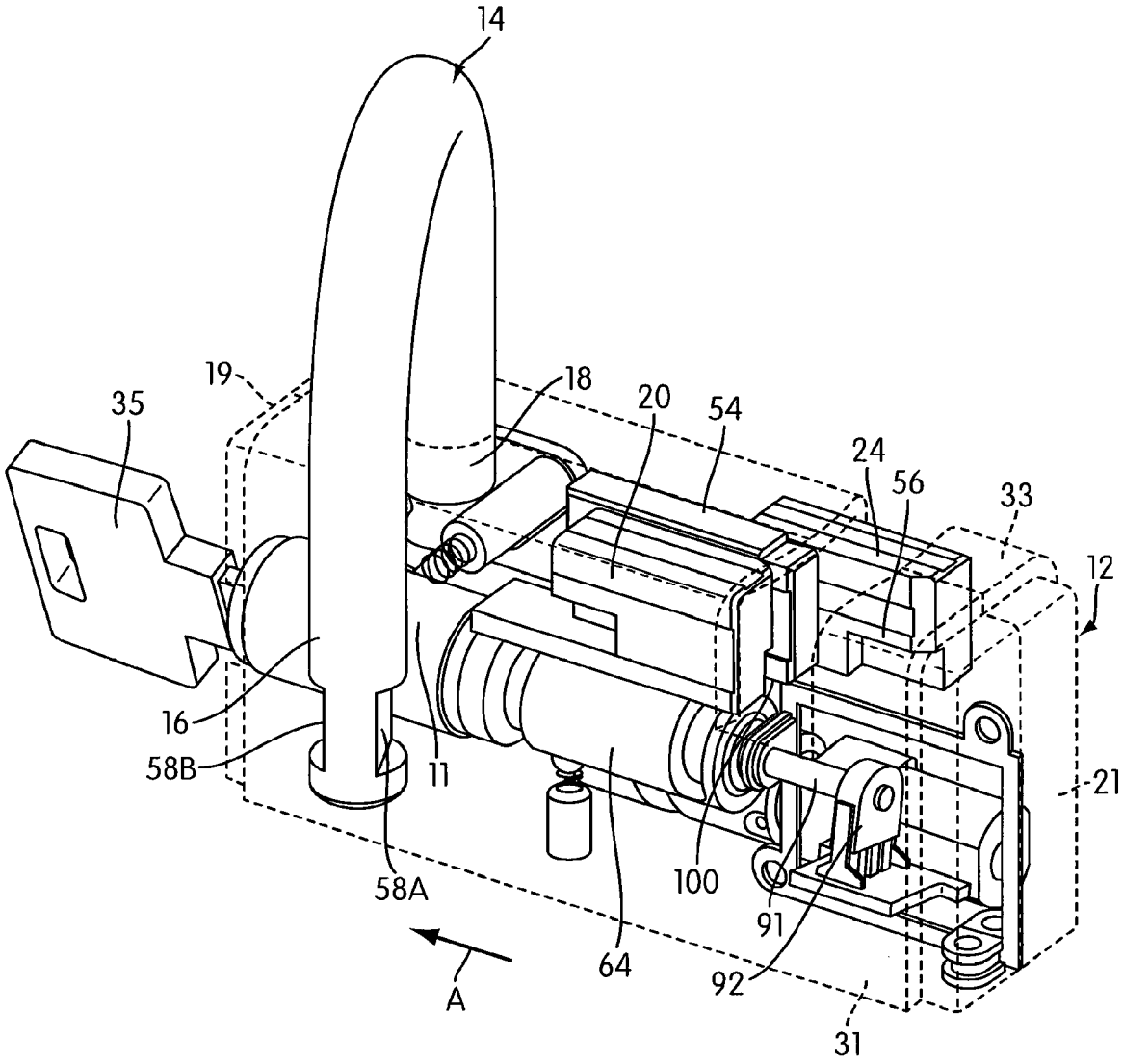
FIG. 10 is a perspective view of a portion of the electronic and manual lock assembly in the unlocked position using the mechanical assembly with the lock housing shown in dotted lines to better show the electronic and manual lock assembly components enclosed therein in accordance with an embodiment.
Figure 11:
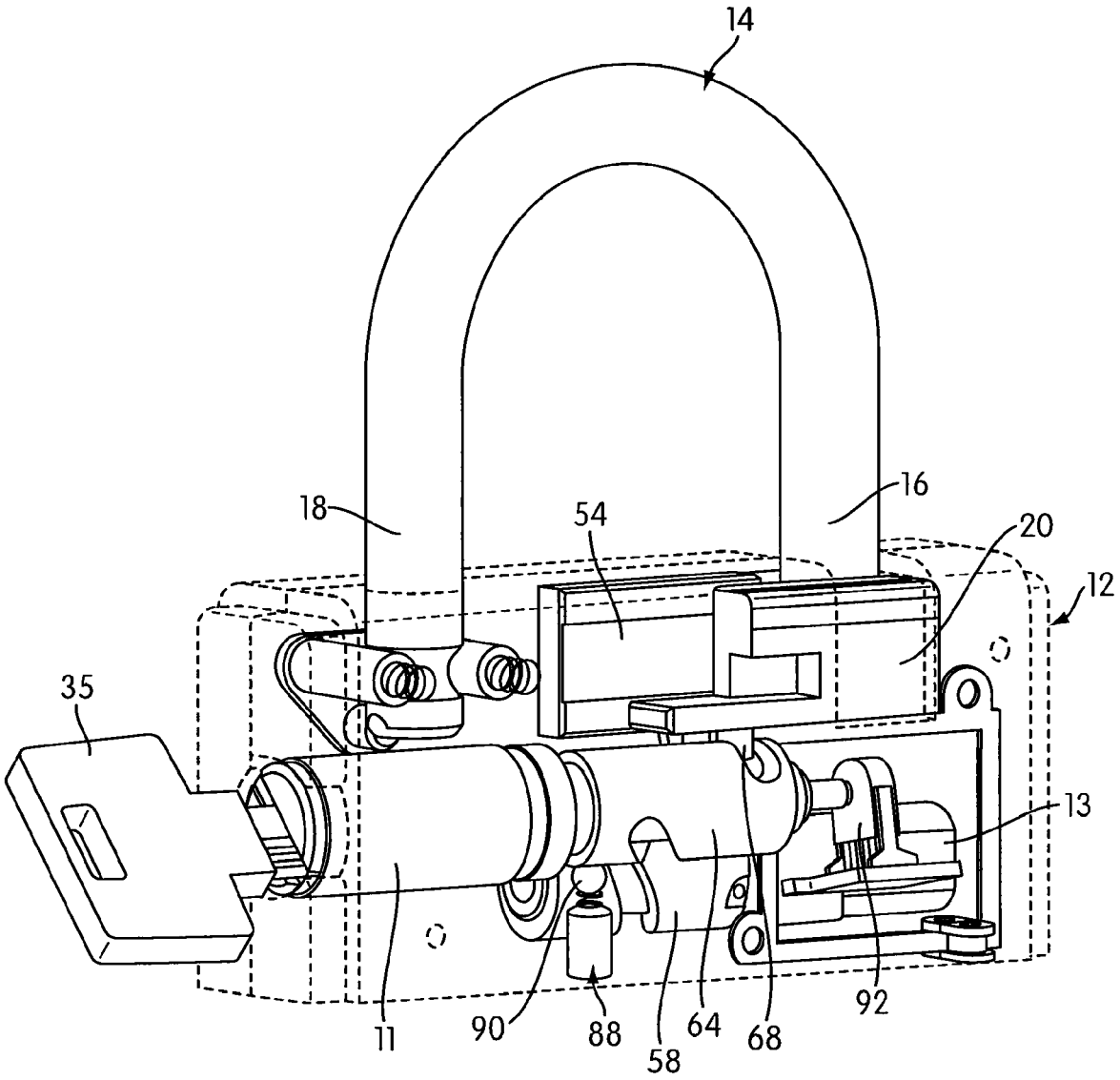
FIG. 11 is a perspective view of a portion of the electronic and manual lock assembly in the locked position with the lock housing shown in dotted lines to better show the electronic and manual lock assembly components enclosed therein in accordance with an embodiment.

FIG. 10 shows a rear perspective view of the lock 10 with the lock housing 12 shown in a transparent manner to better show the components enclosed therein. In this embodiment, the first stop member 20 is moved in the direction of A towards the right side 19 such that an opening 100 in the lock housing 12 is accessible. Accordingly, the first leg 16 is rotatable out of the lock housing 12 through the opening 100. The opening 82 through which the first leg 12 may rotate when the second lock member 24 is moved and the opening 100 through which the first leg 16 may rotate when the first lock member 20 is moved may form the opening 33 of the lock housing 12. FIG. 11 shows a rear perspective view of the lock 10 in the locked position and with the lock housing 12 shown in a transparent manner to better show the components enclosed therein.

Figure 12:
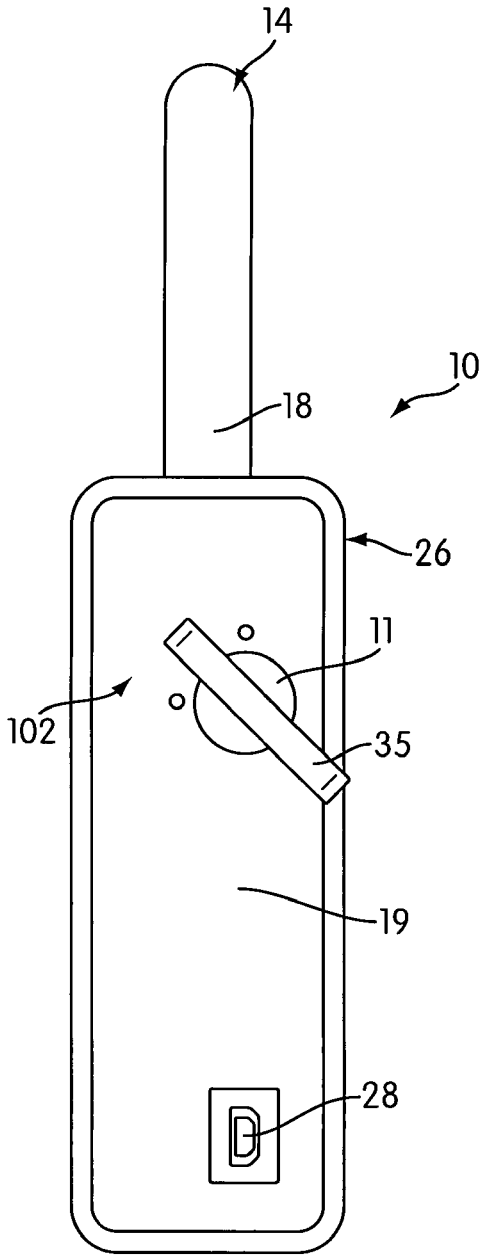
FIG. 12 is a plan view of a right side of the electronic and manual lock assembly in accordance with an embodiment.

FIG. 12 is a plan view of the right side 19 of the lock 10. In this Figure, the mechanical key 35 is received in the mechanical lock 11 and is rotated in a counterclockwise direction. Indication marks 102 are provided on the right side 19 of the lock 10 to indicate to the master user 48 the operations that the lock 10 may perform. Thus, by rotating the mechanical key 11 to such positions associated with the indicator marks 102, the master user 48 may select an operation of the lock 10. In one embodiment, the mechanical key 35 may be rotated in the clockwise direction to move the first stop member 20 so as to unlock the lock 10. Thus, in such embodiment, the mechanical lock 11 may be operated by the mechanical key 35 to unlock the lock mechanically as well as to select an operation for the lock 10 to perform using electronic components of the lock 10.

Figure 13A:
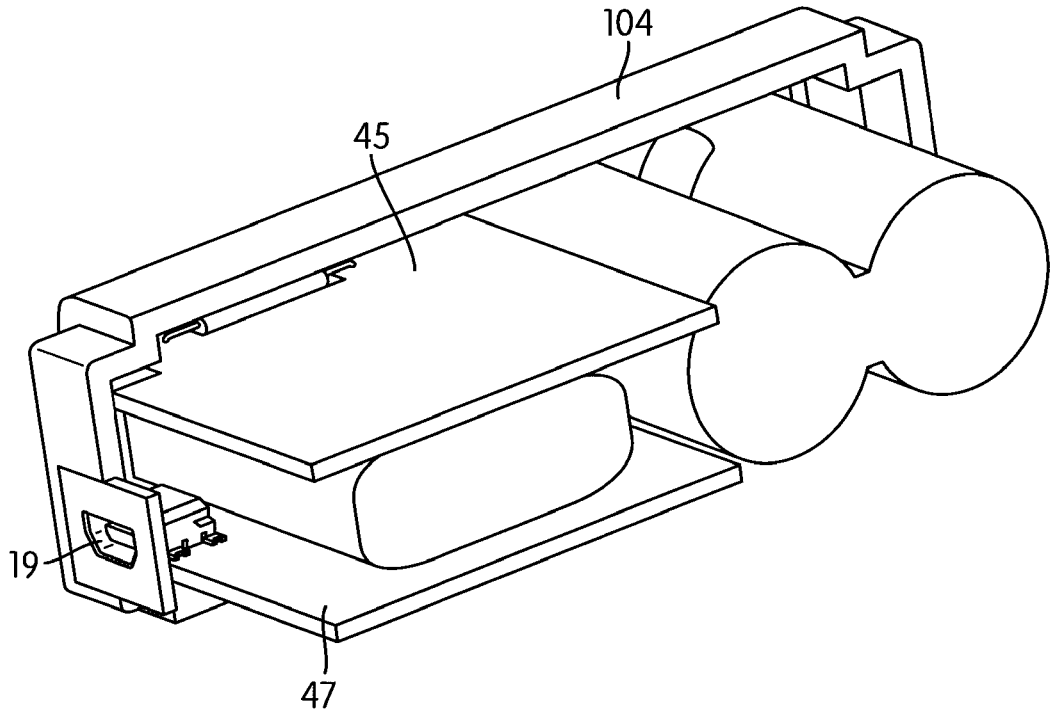
FIGS. 13*a*-13*c* are perspective views of portions of the electronic and manual lock assembly in accordance with an embodiment.
Figure 13B:
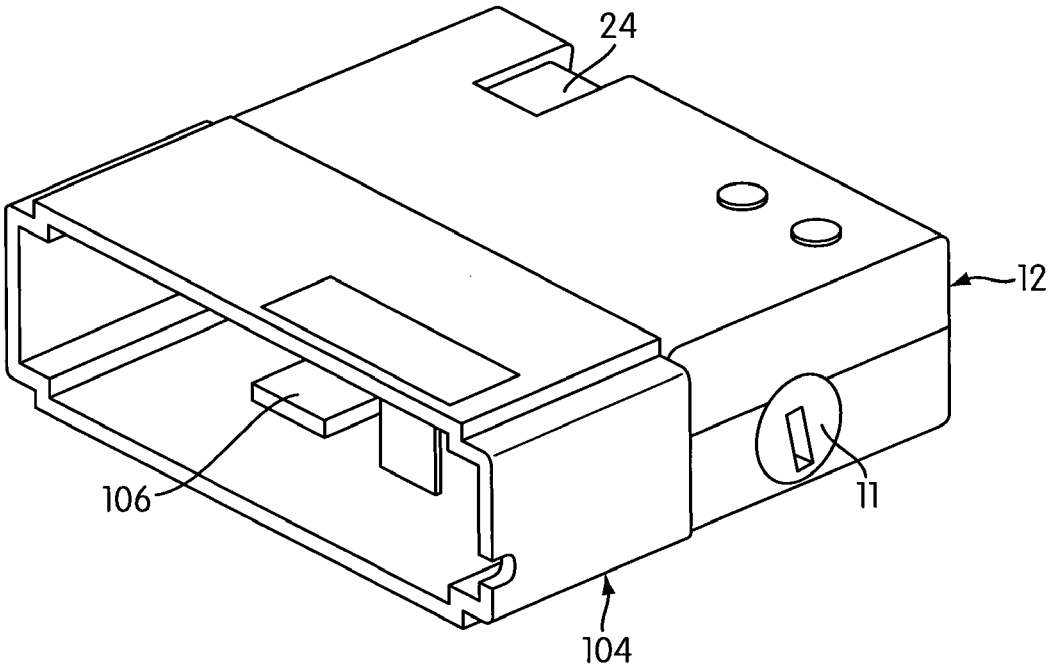
Figure 13C:
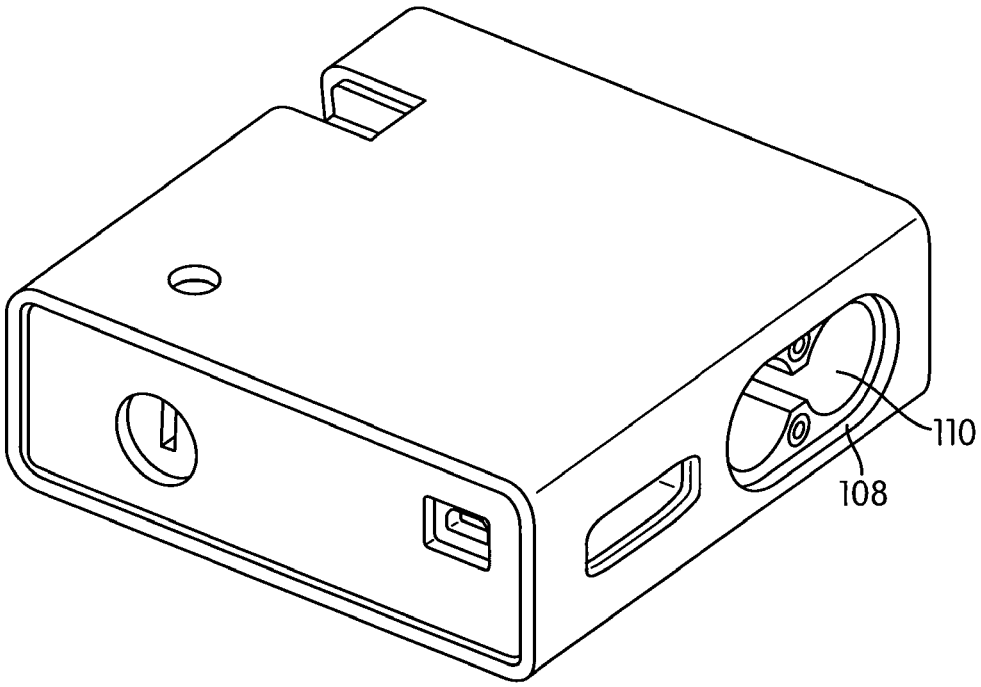

FIG. 13*a* shows an electronics compartment 104 constructed and arranged to retain the controller 40 and the RFID reader 46 therein. In this embodiment, the controller 40 is provided in a main PCB (printed circuit board) 45 and the RFID reader 46 is provided on an RFID PCB (printed circuit board) 47. In this embodiment, the RFID reader 46 and the controller 40 are on separate PCBs 45, 47 but are in communication with each other. In some embodiments, the RFID reader 46 and the controller 40 may be provided on the same PCB board. FIG. 13*b* shows the electronic compartment 104 connected to the lock housing 12. A motor and encoder connector 106 may be provided in the compartment 104 to electronically connect the motor 13 and the encoder 92 to the controller 40 and/or the RFID reader 46. FIG. 13*c* shows the lock housing 12 and the electronic compartment 104 enclosed by the outer housing 26. Openings 108 are formed in the outer housing 26 to enable the batteries 38 to be inserted into or removed from a battery compartment 110 in the electronic compartment 104.

Figure 15:
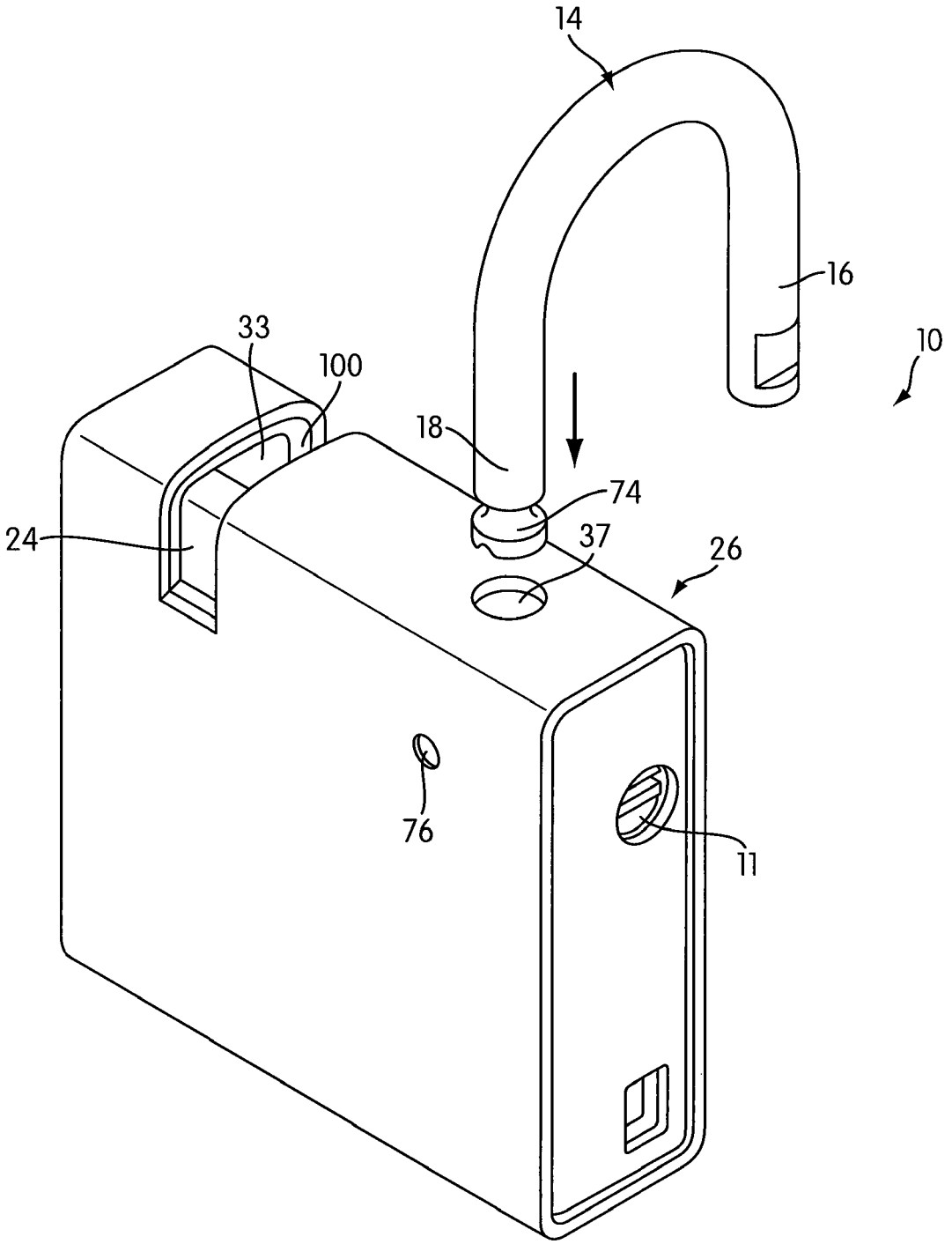
FIG. 15 is a perspective view of the electronic and manual lock assembly with the shackle removed from the electronic and manual lock assembly in accordance with an embodiment.

FIG. 15 shows an embodiment of the lock 12 with the shackle 14 removed from the lock 10. In this embodiment, the outer casing 26 are provided with openings that correspond with the openings 33, 37 of the lock housing 12. To unlock the lock 10, the shackle 14 is not removed from the lock housing 12 (i.e., both legs 16,18 are not removed from the lock housing 12), and instead, the shackle 14 pivots along the second leg 18 which remains in the lock housing 12 while the first leg 16 is rotated out of the lock housing 12. However, in some embodiments, the shackle 14 may removed and replaced with another shackle 14 to adjust to the object that the lock 10 is intended to lock. Thus, the shackle 14 may be removed for replacement purposes using the actuating portion 76 of the retaining structure 70. In this embodiment, the actuating portion 76 of the retaining structure 70 extends through the outer casing 26 and is accessible by a user 44 or a master user 48. Operation of the actuating portion 76 to enable removal and replacement of the shackle 14 will be described in more detail below.

Figure 14A:
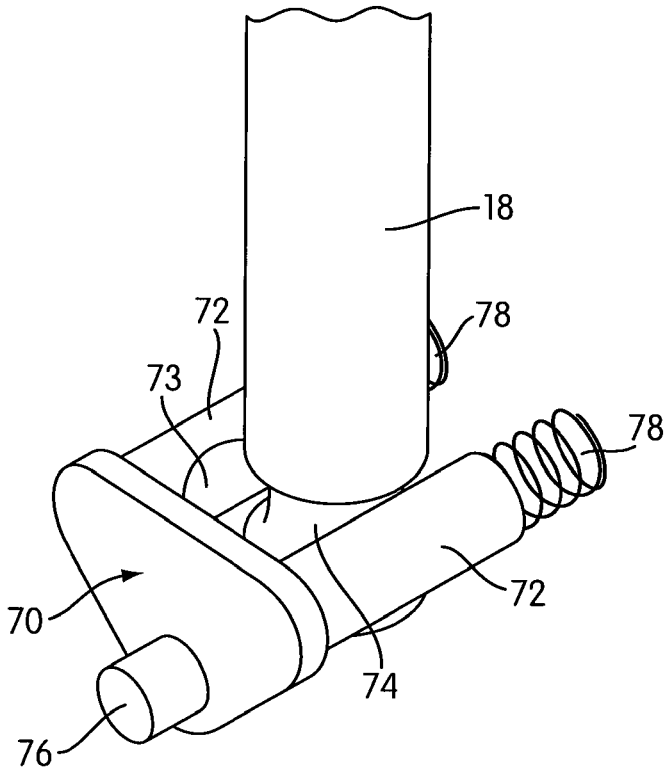
FIGS. 14*a*-14*c* illustrate removal of a shackle of the electronic and manual lock assembly in accordance with an embodiment.
Figure 14B:
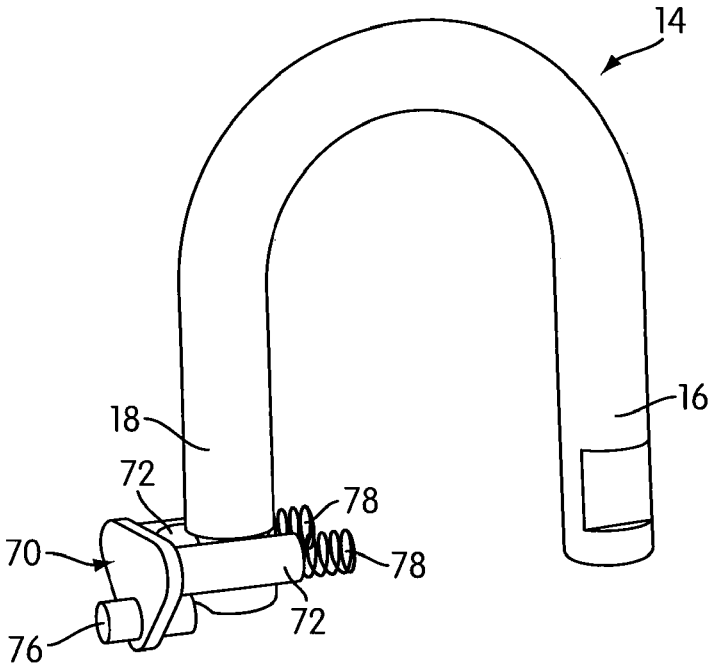
Figure 14C:
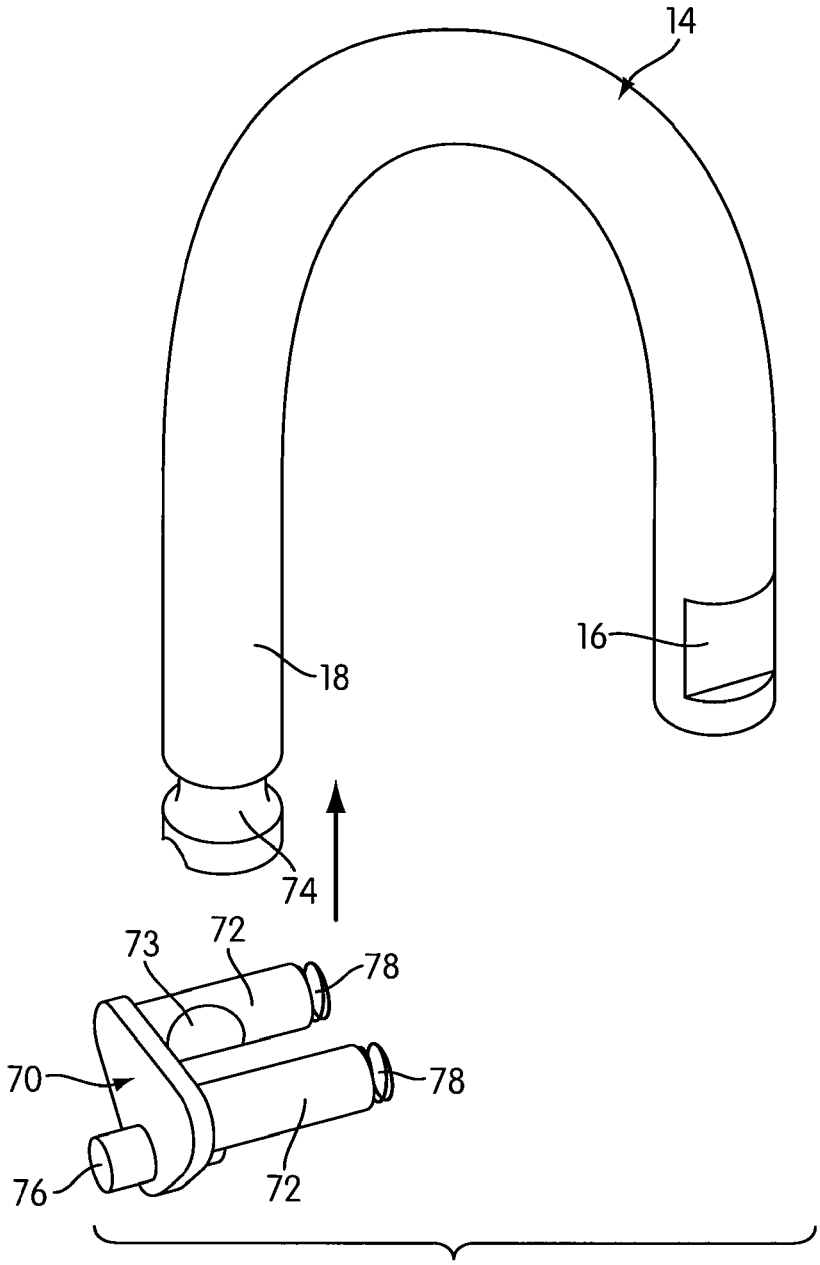

The shackle 14 may be removed from the lock housing 12 in accordance with an embodiment as follows. The second leg 18 of the shackle 14 may be retained by the retaining structure 70 in the lock housing 12 during locking and unlocking of the lock 10, as shown in FIG. 14*a*. As shown in this Figure, the pair of legs 72 of the retaining structure 70 are received in the groove 74 of the second leg 18, thus retaining the second leg 18 within the lock housing 12 and enabling the second leg 18 to pivot within the lock housing 12. After the lock 10 has been unlocked and the first leg 16 is rotated out of the lock housing 12, as shown in FIG. 14*b*, the user 44 or master user 48 may actuate the actuating portion 76 of the retaining structure 70. This actuation may push the retaining structure 70 against the bias of the biasing members 78 until the second leg 18 is aligned with the recesses 73 formed in the pair of legs 72 of the retaining structure 70 and the pair of legs 73 are no longer received in the groove 74 of the second leg 18. Accordingly, the recesses 73 formed in the legs 72 enable the second leg 18 to be pulled away from the retaining structure 70, as shown in FIG. 14C. A new shackle 14 may then be inserted between the recesses 73 formed in the legs 72 of the retaining structure 70 until the recesses 73 are aligned with the groove 74 formed in the second leg 18 of the shackle 14. The user 44 or master user 48 may then cease actuation of the actuating portion 76, whereupon the biasing members 78 may push the retaining structure 70 back to the position shown in FIG. 14*a* and portions of the pair of legs 72 are received in the groove 74 of the second leg 18.

As mentioned above, the mechanical assembly 98 may operate independently of the electronic assembly 86. That is, the lock 10 may be unlocked using either one or both the mechanical assembly 98 and the electronic assembly 86. The electronic assembly 86 may be constructed and arranged to move the second stop member 24 to permit rotation of the first leg 16 out of the lock housing 12 in the direction of C (see FIG. 5), and the mechanical assembly 98 may be constructed and arranged to move the first stop member 20 to permit rotation of the first leg 16 out of the lock housing 12 in the direction of B (see FIG. 5). The mechanical assembly 98 does not require power to lock/unlock the lock 10, and thus may operate to lock/unlock the lock 10 even when the batteries 38 lack power or power is not provided to the lock 10. However, it should be appreciated that some components of the mechanical assembly 98 may require power to operate, such as the encoder 92. Thus, although the other operations that the master user 48 may perform using the mechanical key 35 (e.g., pairing, deletion of unlock codes/identification information, connecting to PC) may require power to operate, the unlocking/locking functions do not require power.

The lock 10 may be mechanically unlocked in accordance with an embodiment as follows. The lock 10 may initially be in a locked position shown in FIG. 5. The user may insert the mechanical key 35 into the lock 11 as shown in FIG. 8 and rotate the mechanical key 35 in the clockwise direction (in the view of FIG. 8). The rotation of the mechanical key 35 may cause the mechanical lock 11 to rotate. The guide structure 64, which is coupled to the mechanical lock 11, is also rotated in the clockwise direction. While the guide structure 64 is rotated, the spiral groove 66 formed in the guide structure 64, which receives the extension 68 of the first stop member 20, guides the extension 68 in the direction of A. Accordingly, the extension 68 of the first stop member 20 is moved from its position (see FIG. 8) closer to the second end 67 to its new position closer to the first end 65. Thus, the first stop member 20 is moved towards the right side 19 of the lock 10 such that the opening 100 is accessible to enable the first leg 16 to be rotated out of the lock housing 12 through the opening 100, as shown in FIG. 10.

The lock 10 may be locked in accordance with an embodiment as follows. The lock 10 may initially be in the unlocked position with the opening 100 accessible to enable the first leg 16 of the lock shackle 14 to be rotated out of the lock housing 12, as shown in FIG. 10. The master user 48 may rotate the first leg 16 back into the lock housing 12 through the opening 100. The master user 48 may then rotate the lock (in the clockwise direction in the view shown in FIG. 10 and in the counterclockwise direction in the view shown in FIG. 8) so that the mechanical lock 11 is rotated, which also causes the guide structure 64 to rotate. The spiral groove 66 formed on the guide structure 64 guides the extension 68 of the first stop member 20 and moves the first stop member 24 back to the position shown in FIG. 8. Accordingly, the lock 10 is returned to its locked position wherein the first leg 16 of the shackle 14 cannot be rotated out of the lock housing 12.

Figure 16:
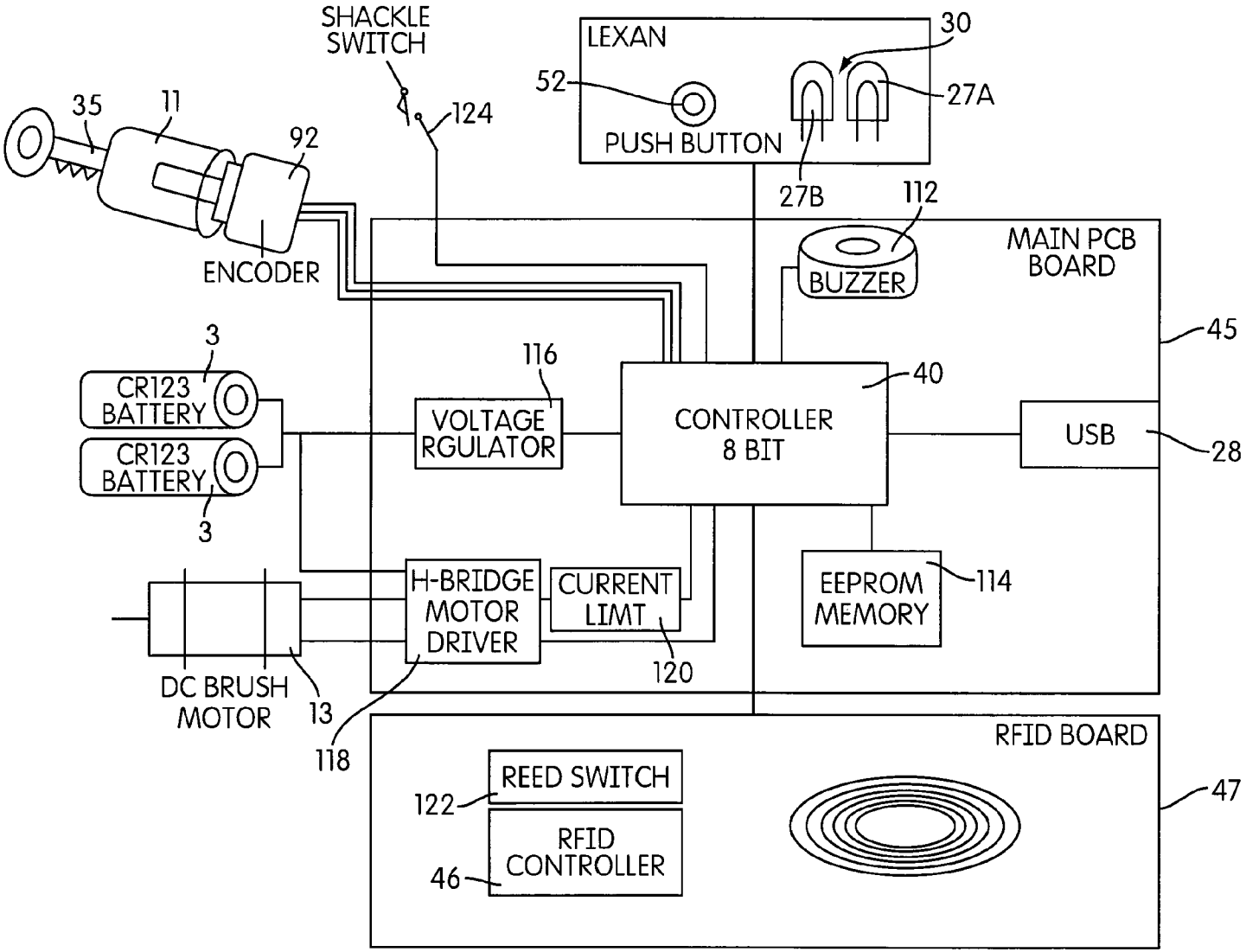
FIG. 16 is a schematic view of electronic components of the electronic and manual lock assembly in accordance with an embodiment.

FIG. 16 illustrates a schematic diagram of the electronic components of the lock 10. In this embodiment, the USB 28, buzzer 112, a memory 114 (taking the form of an EEPROM memory in this embodiment) may be connected to and in communication with the controller 40. The controller 40 and memory 114 may communicate with a personal computer 29 or other electronic devices via the USB 28. Data, such as data associated with events and status of the lock 10 (i.e., actions performed by or on the lock 10), unlock codes, and/or user identification information associated with the electronic key 34 may be transmitted to the personal computer 29 or other electronic devices. Accordingly, the events history and unlock codes/user identification information for the authorized electronic keys 34 may be viewed on the personal computers 29 or electronic devices. In some embodiments, the data may be edited or more information associated with the electronic keys 34 may be added to the entries in the databases using the PC or other electronic device and then transmitted back to the controller 40 for storage in the memory 114. In some embodiments, the name of the users 44 or other identification information associated with the users 44 may be added to the databases. The controller 40 may receive and transmit information, such as use history of the lock 10, unlock codes, status history, or other data to and from the personal computer 29 or other electronic devices.

The buzzer 112 may be configured to emit noise to indicate a status of the lock 10, to indicate that the electronic key 34 does not contain an authorized unlock code, or to indicate other information. The light arrangement 30 may also be used to indicate information to the user 44 or the master user 48. The button 32 may be used by the user 44 or the master user 48 to input information to the controller 40. In some embodiments, other visual or audible signals may be used to indicate an event or status associated with the lock 10. Just for example, there may be a vibrating device that vibrates the lock to indicate an event or status.

In some embodiments, the buzzer 112 may be configured to emit a tone and the green LED light 27B may blink when a correct operation is performed. The correct operation may be an operation that the user 44 is authorized to perform using the lock 10 and the lock 10 is capable of performing such an operation. In one embodiment, the buzzer 112 emits high frequency tones when the operation is incorrect (e.g., the user 44 is not authorized to perform such operation or the lock 10 is incapable of performing the operation at the time). In such situations, the red LED light 27A may also blink at a high frequency. In one embodiment, if an event is about to occur or if the lock 10 is programmed to perform a certain operation at a certain time or after a period of time, the lock 10 may warn the users 44 and the master users 48 by emitting an increasing frequency tone and ending with a long single tone using the buzzer 112. The green LED light 27B may blink at an increasing rate and the red LED light 27B may also blink at an increasing rate until both lights 27A, 27B stay lit. In one embodiment, the green LED light 27B may blink at a slow rate to signal that the lock 10 is in a "standby" mode, wherein the lock 10 is ready to be unlocked by an authorized user 44 or by a master user 48. The "standby" mode may also be considered a power saving mode. In one embodiment, the red LED light 27A may blink at a slow rate to signal that the batteries 38 are low in power or if there are defects associated with the lock 10.

Referring back to FIG. 16, the encoder 92 is connected to the controller 40 to communicate positional or directional motion of the mechanical lock 11 due to the movement of the mechanical key 35 by the master user 48. A voltage regulator 116 may be operatively connected to the batteries 38 to maintain constant voltage level supplied to the other electronic components of the lock 10. A motor driver 118 (taking the form of an H-Bridge motor driver) may be connected to the motor 13 to drive the motor 13 (taking the form of a DC brush motor) in either direction (forwards or backwards). It should be appreciated that other types of motor drivers and motors may be used in other embodiments. A current limiter 120 may be provided to impose an upper limit on the current delivered to a load so as to protect the circuit from harmful effects due to a short-circuit or similar problem in the load and/or to limit the rotational movement of the motor 13 and the guide structure 58.

A shackle switch 124 may also be in communication with the controller 40. The shackle switch 124 may be configured to sense the position of the shackle 14. For example, the shackle switch 124 may sense that the first leg 16 of the shackle 14 is within the lock housing 12 and may communicate this information to the controller 40. It should be appreciated that this shackle switch 124 may be optional. Thus, some embodiments may have the shackle switch 124 while others may not. It is also contemplated in embodiments having the shackle switch 124, the shackle switch 124 may be an optical sensor, an electromechanical device, or any other types of devices/sensors.

In the embodiment of FIG. 16, the RFID reader 46 may be provided on the RFID PCB 47. An activation sensor 122, taking the form of a reed switch in this embodiment, may be provided in the slot 32 of the lock 10 and may be used to sense the insertion of an electronic key 34 into the slot 32. In embodiments where the activation sensor 122 is a reed switch, the electronic key 34 may include a magnet or a device that produces a magnetic field such that when the electronic key 34 is inserted into the slot 32 near the sensor 122, the contacts of the switch, which are normally open, may close. In other embodiments, the contacts of the switch may be normally closed until magnetic field is applied, whereupon the contacts open. It should also be appreciated that optical sensors, mechanical sensors, or other types of sensors may be used. In addition, the lock 10 may also include a timer device (not shown) constructed and arranged to communicate time and timing to the controller 40. A backup battery may be provided with the timer device such that the timer device may function even when power is no longer supplied to the lock 10.

Figure 17:
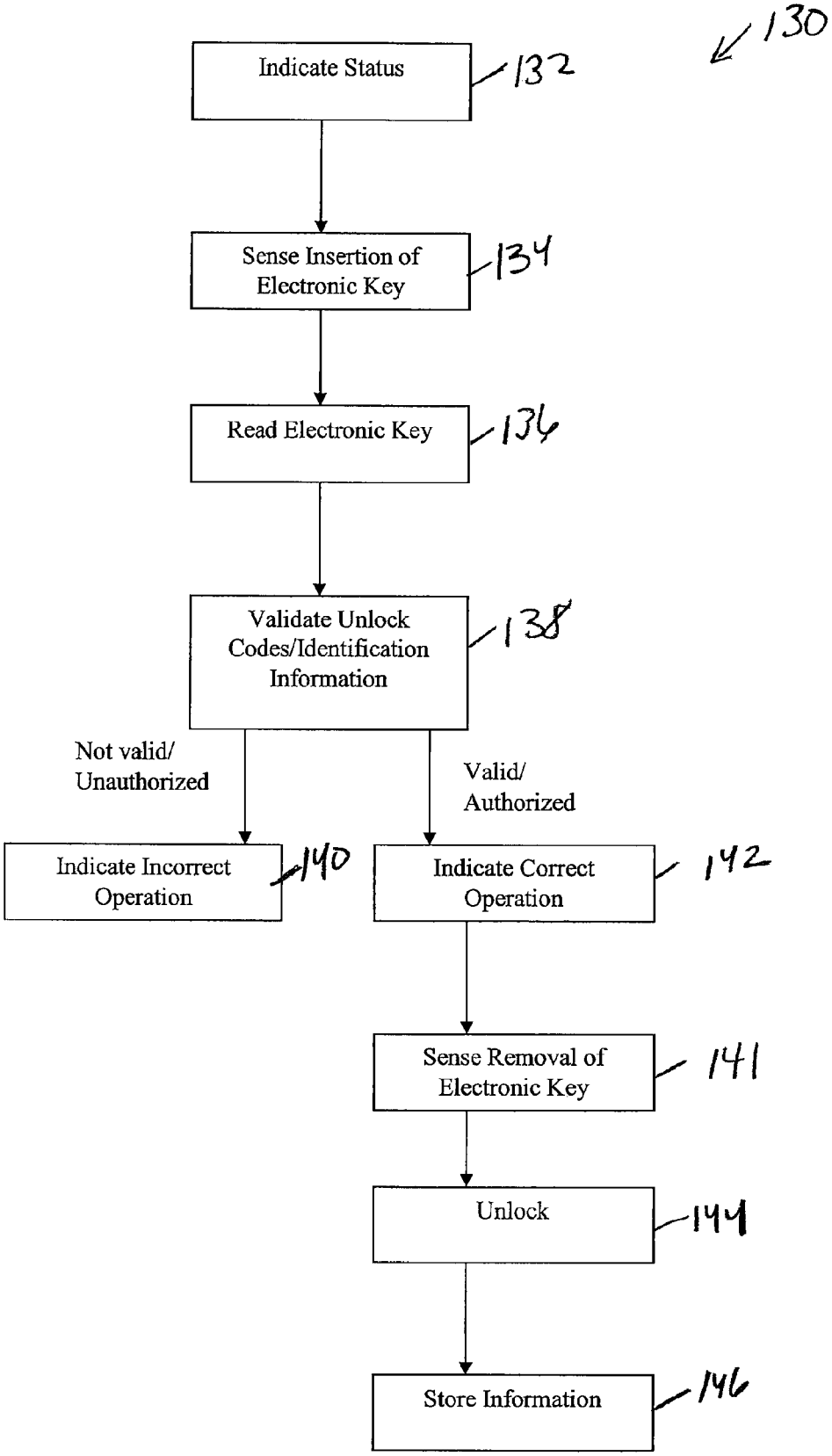
FIG. 17 is a flow diagram illustrating a method of unlocking the electronic and manual lock assembly using the electronic assembly in accordance with an embodiment.

FIG. 17 shows an unlocking operation 130 of the lock 10 using the electronic key 34 in accordance with an embodiment as follows. In procedure 132, the lock 10 may initially be locked and in a standby mode with the green LED light 27B blinking at slow rate to signal its mode. The user 44 or master user 48 may then insert the electronic key 34 into the slot 32 provided in the lock 10. The operation 130 proceeds to procedure 134, wherein the magnet included in the electronic key 34 may activate the activation sensor 122 to signal to the RFID reader 46 and/or the controller 40 that an electronic key 34 has been inserted into the lock 10. In procedure 136, the RFID reader 46 may be used to supply power to the passive RFID device in the electronic key 34 such that the electronic key 34 transmits signals including unlock codes and/or user identification information to the RFID reader 46. The RFID reader 46 may then transmit this information to the controller 40 so that the controller 40 may validate the electronic key 34 in procedure 138 by comparing the unlock code/identification information with the data stored in the memory 114. If the controller 40 determines that the unlock code and/or user identification information transmitted from the electronic key 34 is not authorized (e.g., does not match with the user identification information/unlock codes in the memory 114), the operation 130 proceeds to procedure 140 wherein the controller 40 signals the lock 10 to indicate that the operation is incorrect. In such situations, the red LED light 27A may blink at a fast rate a limited number of times (e.g., 3) and the buzzer 112 may emit a limited number (e.g., 3) of high frequency tones. Alternatively, if the controller 40 determines that the unlock code/identification information from the electronic key 34 is authorized or valid (e.g., the unlock code/identification information matches data stored in the memory 114), then the operation 130 proceeds to procedure 142 wherein the lock 10 indicates that the operation is correct. In such situations, the buzzer 112 may emit a single tone and the green LED light 27B may blink a limited number of times (e.g., once). The user 44 or master user 48 may the remove the electronic key 34 from the lock 10. The operation 130 then proceeds to procedure 141 wherein the activation sensor 122 senses the absence of a magnetic field and signals the controller 40 that the electronic key 34 has been removed from the lock 10. The operation 130 then proceeds to procedure 144 wherein the controller 40 controls the motor driver 118 to drive the motor 13 such that the stop member 24 is moved to unlock the lock 10. In one embodiment, the motor driver 118 may drive the motor 13 until a current limit has been reached. The operation 130 then proceeds to procedure 146 wherein event information, such as the user identification/unlock code associated with the electronic key 34 may be stored in the memory 114. Other information associated with the event, such as time/date of the unlocking of the lock 10 and the user name may also be stored in the memory 114. The lock 10 may then be in the standby open or unlocked mode wherein the shackle 14 is rotatable out of the lock housing 12. If the battery power is low, the lock 10 may indicate such status by blinking the red LED light 27A at a high frequency for a limited number of times.

The motor 13 may move the second stop member 24 as follows in accordance with an embodiment. The lock 10 may initially be a locked position as shown in FIG. 5. During unlocking using the electronic assembly 86, the motor 13 may be rotated by the motor driver 118 in a clockwise direction (in the view of FIG. 5). Accordingly, the guide structure 58 coupled to the motor 13 may also be rotated in the clockwise direction. During rotation, the guide structure 58 may pull the extension 62 of the second stop member 24 (and thus the entire stop member 24) from its initial position near the first end 55 of the guide structure 58 in the direction of A. This may be accomplished in the embodiment shown in FIG. 5 by the rotation of the guide member 58 which causes the extension 62 of the stop member 24 to move within the grooves 60 of the guide structure 58 until the extension 62 of the stop member 24 is closer to the second end 57 than to the first end 55 as shown in FIG. 6. Thus, the grooves 60 of the guide structure 58 guides the extension 62 in the direction of A. Accordingly, the second stop member 24 is moved in the direction of A until the opening 82 is accessible such that the first leg 16 of the shackle 14 may be rotated out of the lock housing 12 through the opening 82. If the lock 10 is unlocked, but the first leg 16 of the shackle 14 is not rotated out of the lock housing 12 after a duration of time (e.g., 30 seconds), the lock 10 may automatically lock again by moving the second stop member 24 back to the position shown in FIG. 5.

Figure 18:
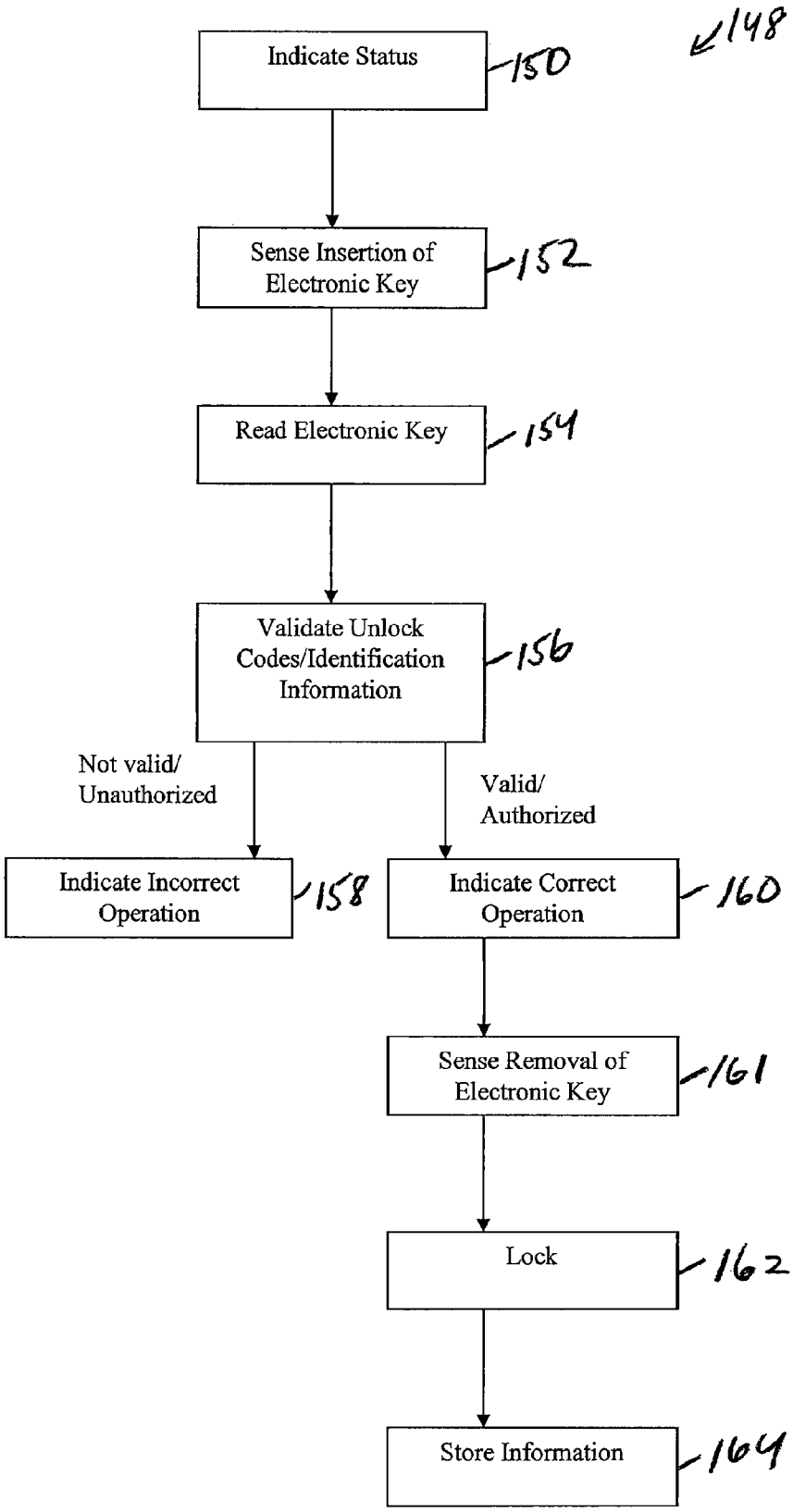
FIG. 18 is a flow diagram illustrating a method of locking the electronic and manual lock assembly using the electronic assembly in accordance with an embodiment.

FIG. 18 shows a locking operation 148 of the lock 10 using the electronic key 34 in accordance with an embodiment as follows. In procedure 150, the lock 10 may initially be unlocked and in a standby mode with the green LED light 27B blinking at slow rate to signal its mode. The user 44 or master user 48 may then insert the electronic key 34 into the slot 32 provided in the lock 10. The operation 148 proceeds to procedure 152, wherein the magnet included in the electronic key 34 may activate the activation sensor 122 to signal to the RFID reader 46 and/or the controller 40 that an electronic key 34 has been inserted into the lock 10. In procedure 154, the RFID reader 46 may be used to supply power to the passive RFID device in the electronic key 34 such that the electronic key 34 transmits signals including unlock codes and/or user identification information to the RFID reader 46. The RFID reader 46 may then transmit this information to the controller 40 so that the controller 40 may validate the electronic key 34 in procedure 156 by comparing the unlock code/identification information with the data stored in the memory 114. If the controller 40 determines that the unlock code and/or user identification information transmitted from the electronic key 34 is not authorized (e.g., does not match with the user identification information/unlock codes in the memory 114), the operation 148 proceeds to procedure 158 wherein the controller 40 signals the lock 10 to indicate that the operation is incorrect. In such situations, the red LED light 27A may blink at a fast rate a limited number of times (e.g., 3) and the buzzer 112 may emit a limited number (e.g., 3) of high frequency tones. Alternatively, if the controller 40 determines that the unlock code/identification information from the electronic key 34 is authorized or valid (e.g., the unlock code/identification information matches data stored in the memory 114), then the operation 148 proceeds to procedure 160 wherein the lock 10 indicates that the operation is correct. In such situations, the buzzer 112 may emit a single tone and the green LED light 27B may blink a limited number of times (e.g., once). The user 44 or master user 48 may then remove the electronic key 34 from the lock 10. The operation 148 then proceeds to procedure 161 wherein the activation sensor 122 senses the absence of a magnetic field and signals the controller 40 that the electronic key 34 has been removed from the lock 10. The operation 148 then proceeds to procedure 162 wherein the controller 40 controls the motor driver 118 to drive the motor 13 such that the second stop member 24 may be moved to lock the lock 10. In one embodiment, the motor driver 118 may drive the motor 13 until a current limit has been reached. The event information, such as the user identification/unlock code associated with the electronic key 34 may be stored in the memory 114 in procedure 164. Other information associated with the event, such as time/date of the locking of the lock 10 and the user name may also be stored in the memory 114. The lock 10 may then be in the standby closed or locked mode wherein the shackle 14 is prevented from being rotated out of the lock housing 12. If the battery power is low, the lock 10 may indicate such status by blinking the red LED light 27A at a high frequency for a limited number of times.

To move the second stop member 24 to lock the lock 10 using the electronic assembly 86, the controller 40 may signal the motor driver 118 to rotate the motor 13 in a clockwise direction (in the view shown in FIG. 6). The guide structure 58 which is coupled to the motor 13, may then be rotated in the clockwise direction. The grooves 60 in the guide structure 58 may then guide the extension 62 of the second stop member 24 in the direction opposite of A until the extension 62 is closer to the first end 55 of the guide structure 58. Accordingly, the second stop member 24 prevents access to the opening 82 and prevents the first leg 16 of the shackle 14 from being rotated out of the lock housing 12.

In the exemplary embodiments described above, the electronic key 34 should be removed from the lock 10 before the lock 10 can be unlocked/locked. This feature wherein the electronic key 34 should be removed prior to the performance of the locking/unlocking operation of the lock 10 may help prevent users 44 or master users 48 from forgetting their electronic keys 34 inside the locks 10.

The master users 48 and the users 44 may remove and replace the batteries 38 by removing the battery cover 36, removing the batteries 38, inserting new batteries 38, and replacing the battery cover 36. In some embodiments, only the master users 48 may restart the lock 10 (e.g., reset the position of the encoder 92), and/or turn the lock 10 on (e.g., "unfreezing" the authorizations by turning on the electronic components of the lock 10 such that the lock 10 can be unlocked or locked using the electronic keys 34) or off (e.g., "freezing" the authorizations by turning off the electronic components of the lock 10 such that the lock 10 cannot be unlocked or locked using the electronic keys 34).

Referring to FIG. 12, the master user 48 may restart the lock 10 or turn the lock 10 on and off by inserting the mechanical key 35 into the mechanical lock 11, and turning the mechanical key 35 in the counterclockwise direction until the mechanical key 35 points to the On/Off/Pairing/PC indication mark 102. The green LED light 27B may then blink once and the buzzer 112 may emit a single buzz.

As mentioned above, in one embodiment, the rotation of the mechanical lock 11 using the mechanical key 35 also rotates the guide structure 64, which in turn is coupled to an encoder 92. Accordingly, the encoder 92 may output signals to the controller 40 according to the movement/position of the mechanical key 35 and the mechanical lock 11. When the mechanical key 35 is turned such that the mechanical key 35 is pointed to the on/off/pairing/pc indication mark 102, the encoder 92 outputs signals indicating this position to the controller 40. Furthermore, as mentioned above, the spring-loaded ball 90 of the indicator 88 is configured to be received in a detent provided on the guide structure 64. Accordingly, during rotation of the guide structure 64 by the mechanical lock 11, the indicator 88 may emit a "click" to signal the master user 48 that the selected position (e.g., the on/off/pairing/pc position) has been reached.

Figure 19:
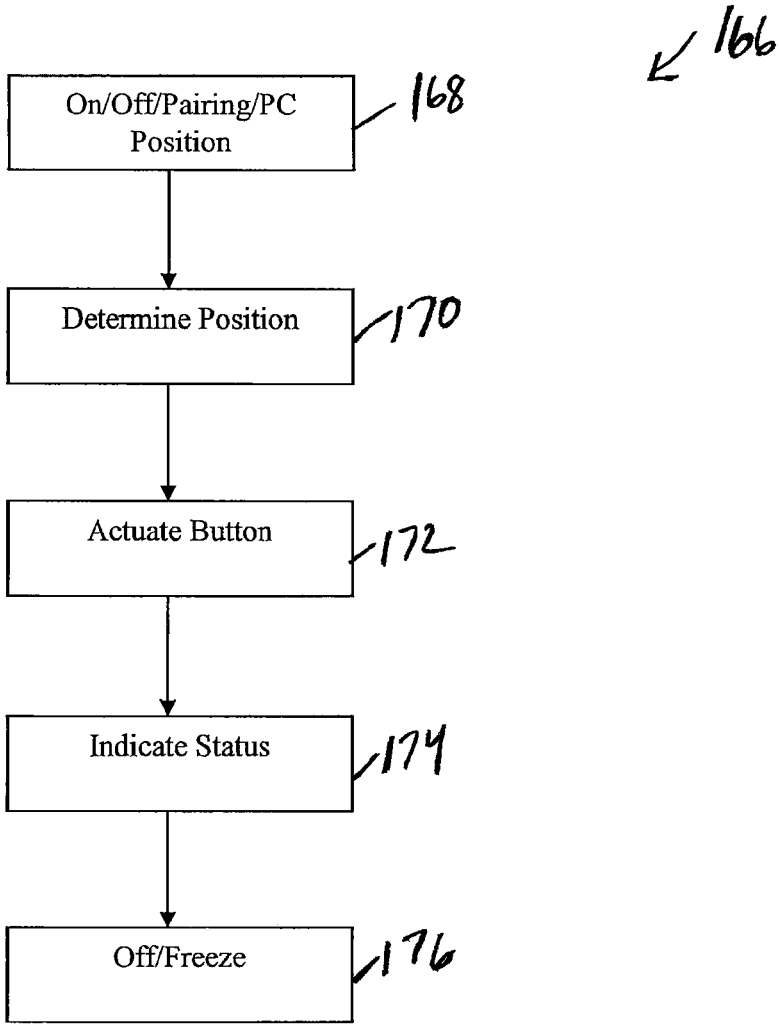
FIG. 19 is a flow diagram illustrating a method of freezing authorizations in accordance with an embodiment.

The lock 10 may be turned off or put in the "freeze" mode using operation 166 shown in FIG. 19 in accordance with an embodiment. To turn the lock off, the master user 48 may turn the mechanical key 35 in the counterclockwise direction in procedure 168 until the mechanical key 35 points to the On/Off/Pairing/PC indication mark 102. In procedure 170, the encoder 92 may output signals to the controller 40 relating to the position/movement of the mechanical key 35 and the mechanical lock 11 as mentioned above. In procedure 172, the button 52 may be actuated by the master user 48. In procedure 174, the status of the lock 10 may be indicated by blinking the green LED light 27B once and emitting a single buzz from the buzzer 112. The lock 10 may then turn off in procedure 176. When the lock 10 has turned off, the lock 10 may be in a power saving mode wherein the lock 10 has a low power consumption. Accordingly, the electronic keys 34 may not be used to unlock/lock the lock 10.

Figure 20:
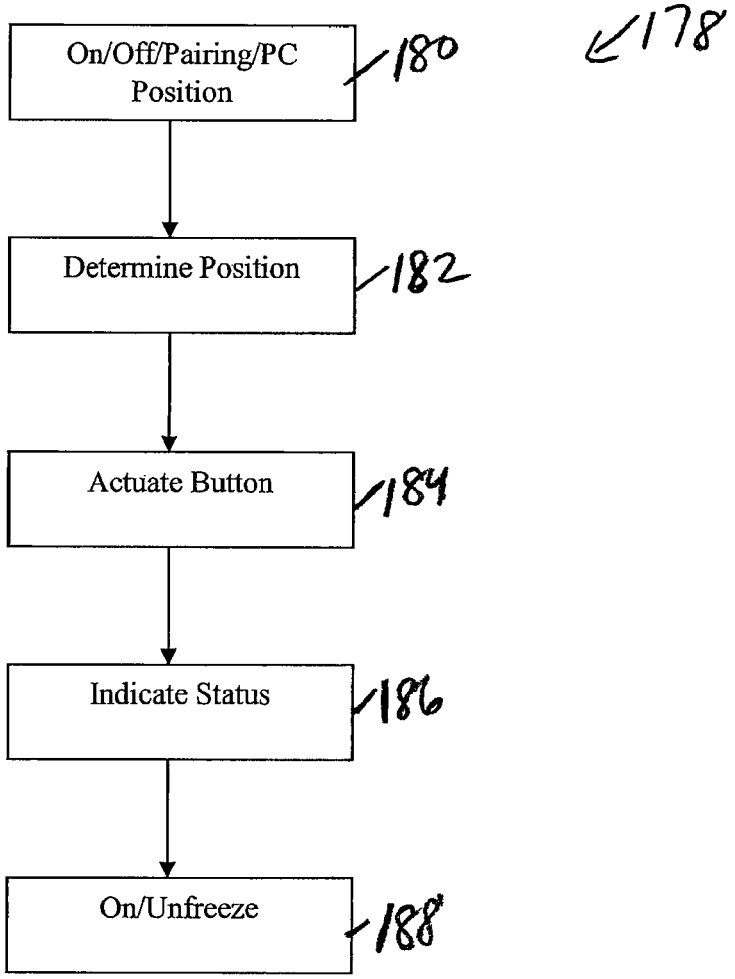
FIG. 20 is a flow diagram illustrating a method of unfreezing authorizations in accordance with an embodiment.

The lock 10 may be turned on or switched to the "unfreeze" mode using operation 178 shown in FIG. 20 in accordance with an embodiment. To turn the lock 10 on, the mechanical key 35 should be inserted into the mechanical lock 11 and rotated until the mechanical key 35 points to the On/Off/Pairing/PC indication mark 102 in procedure 182. The master user 48 may then press the button 52 for a duration of time (e.g., 3 seconds) until the lock 10 indicates that the lock 10 is turned on in procedure 184. The operation 178 may then proceed to procedure 186 wherein the green LED light 27B blinks once and the buzzer 112 emits a single buzz to indicate the status of the lock 10. The lock 10 may then turn on or unfreeze in procedure 188 and will then be in a standby mode to wait for further instructions. However, if the master user 48 rotates the mechanical key back to the key position shown in FIG. 5 without actuating the button 52, the lock 10 may return to the off mode again. If the mechanical key 35 is kept in the On/Off/Pairing/PC position, and if the button 52 is actuated again, the lock 10 may turn off again and the lock 10 may indicate the off status by blinking the green LED light 27B once and emitting a single buzz from the buzzer 112. In addition, if the mechanical key 35 is kept in the On/Off/Pairing/PC position, and a USB cable is inserted into the USB port 28, the lock 10 may proceed to the PC mode described in more detail below. However, if the mechanical key 35 is rotated to the KEY position shown in FIG. 5 and the encoder 92 sends this positional information to the controller 40, the lock 10 may then return to the standby mode. Alternatively, if the mechanical key 35 is rotated to the Delete position shown in FIG. 5 and the encoder 92 sends such positional information to the controller 40, the controller 40 may control the lock 10 to proceed to the Delete mode, which will be described in more detail below.

The lock 10 may communicate with a personal computer 29 or other electronic device in the PC mode in accordance with an embodiment as follows. If the mechanical key 35 is not already in the On/Off/Pairing/PC position, the master user 48 may insert the mechanical key 35 into the mechanical lock 11 and rotate the mechanical key 35 to the On/Off/Pairing/PC indicator mark 102 as described above. The green LED light 27B may then blink once and the buzzer 112 may emit a single buzz. As mentioned above, the encoder 92 may send signals to the controller 40 regarding the movement of the mechanical key 35 and the mechanical lock 11 to the On/Off/Pairing/PC position. A USB cable may then be plugged into the USB port 28 and the lock 10 may indicate that this is a correct operation by emitting a single blink using the green LED light 27B and emitting a single buzz using the buzzer 112. The USB power signal may then trigger the controller 40 to become a slave to the computer host 29 or electronic device host. The controller 40 may then control the lock 10 to send data from the memory 114 to the personal computer 29 or other electronic device connected to the lock 10. Events history data may also be uploaded to the personal computer 29 or other electronic devices connected to the lock 10. In some embodiments, it is contemplated that the personal computer 29 or other electronic devices connected to the lock 10 may be used to send instructions to the lock 10. For example, the master user 48 may use the personal computer 29 or the other electronic devices to control operation of the lock 10 rather than using the mechanical key 35. In such embodiments, the master user 48 may delete the current authorization unlock codes/identification information from the memory 114 and may download new authorization unlock codes/identification information to the memory 114 from the personal computer 29 or other electronic devices. The master user 48 may also reset the home position of the encoder 92, unlock/lock the lock 10, pair electronic keys 34 with the lock 10, and/or set the timer device using the personal computer 29 or the other electronic devices connected to the lock 10.

Figure 21:
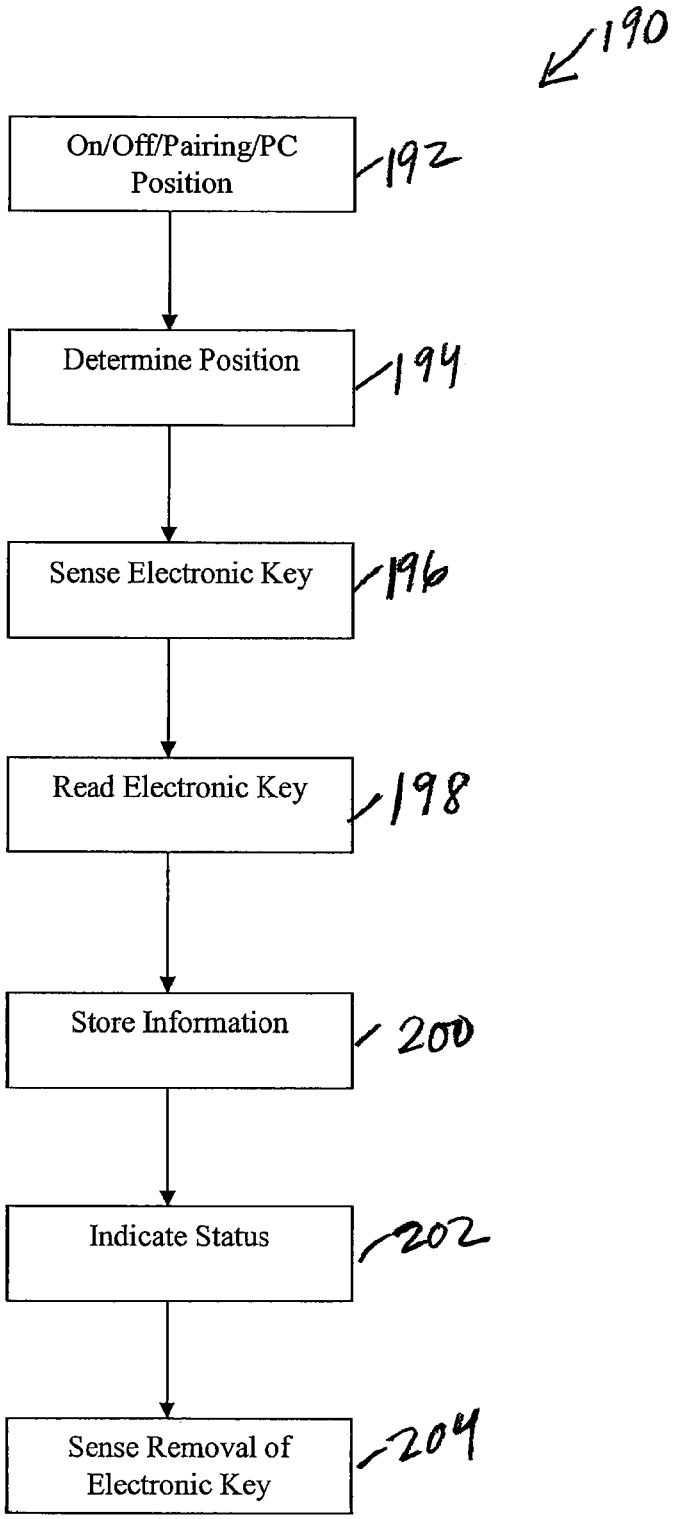
FIG. 21 is a flow diagram illustrating a method of pairing keys in accordance with an embodiment.

Additional electronic keys 34 may be associated with the lock 10 while the lock 10 is in a pairing mode in accordance with an embodiment as follows. That is, during pairing mode, the unlock codes/identification information from additional electronic keys 34 may be added to the memory 114 of the lock 10 so that the electronic keys 34 can be considered "authorized". Operation 190 shown in FIG. 21 may be performed to add these additional electronic keys 34 to the lock in accordance with an embodiment. If the mechanical key 35 is not already in the On/Off/Pairing/PC position, the master user 48 may insert the mechanical key 35 into the mechanical lock 11 and rotate the mechanical key 35 to the On/Off/Pairing/PC indicator mark 102 in procedure 192. The operation 190 may then proceed to procedure 194, wherein the encoder 92 outputs signals to the controller 40 indicating the movement of the mechanical lock 11 and the mechanical key 35 to the On/Off/Pairing/PC position. The master user 48 may then insert the electronic key 34 to be added into the slot 32 in the lock 10. The operation 190 may then proceed to procedure 196 wherein the activation sensor 122 senses the insertion of the electronic key 34. In procedure 198, the RFID reader 46 may be used to supply power to the passive RFID device in the electronic key 34 such that the electronic key 34 transmits signals including unlock codes and/or user identification information to the RFID reader 46. The RFID reader 46 may then transmit this information to the controller 40 so that the controller 40 may store this user identification/unlock code in the memory 114. The operation 190 proceeds to procedure 200 wherein the controller 40 stores the user identification/unlock code in the memory 114. In procedure 202, the green LED light 27B blinks once and the buzzer 112 emits a single buzz to indicate that this is a correct operation and that the information has been stored. The master user 48 may then remove the electronic key 34 from the slot 32 in the lock 10. In procedure 204, the activation sensor 22 senses the removal of the key 11 from the slot 32 and the lock 10 is ready for an additional electronic key 34 to be inserted therein. These events may be stored in memory 114 for transmittal to a personal computer 29 or other electronic devices during PC connection mode.

In operation 190, it is also contemplated that if the button 52 is actuated before procedure 196, the lock 10 may proceed to the off mode as described in operation 166. It is also contemplated that if a USB cable is plugged into the USB port 28 before procedure 196 occurs, the lock 10 may proceed to the PC connection mode described above. It is further contemplated that if the mechanical key 35 is turned to the KEY position shown in FIG. 12 before procedure 196 occurs, the lock 10 may exit the pairing mode and return to a standby mode to await further instructions. It is also contemplated that if the mechanical key 35 is turned to the Delete position shown in FIG. 12 before procedure 196 occurs, the lock 10 may proceed to the delete mode, which will be described in detail below. In operation 190, it is contemplated that if the electronic key 34 is already associated with the lock 10, the lock 10 may refrain from storing the identification information/unlock code that already exists in the memory 114 and may instead just store the event data and the time associated with the event. Furthermore, if an invalid electronic key 34 (e.g., without user identification information/unlock codes that the RFID reader 46 can read) is inserted, the lock 10 may indicate that is an incorrect operation by emitting high frequency tones using the buzzer 112 and blinking the red LED light 27A at a fast rate. Similarly, if the memory 114 is full and additional user identification information/unlock codes cannot be added, the lock 10 may indicate that this is an incorrect operation by emitting high frequency tones using the buzzer 112 and blinking the red LED light 27A at a fast rate. It is also contemplated that these error events or incorrect operations may be stored in the event history in memory 114 (if there is enough space in the memory 114). It is contemplated that in other embodiments, after procedure 196 has occurred, any of the above events may still occur after the associated action is performed. For example, in operation 190, if the button 52 is actuated after procedure 196, the lock 10 may proceed to the off operation described in operation 166. Similarly, if the USB cable is plugged into the USB port 28 after procedure 196 occurs, the lock 10 may proceed to the PC connection mode described above.

Figure 22:
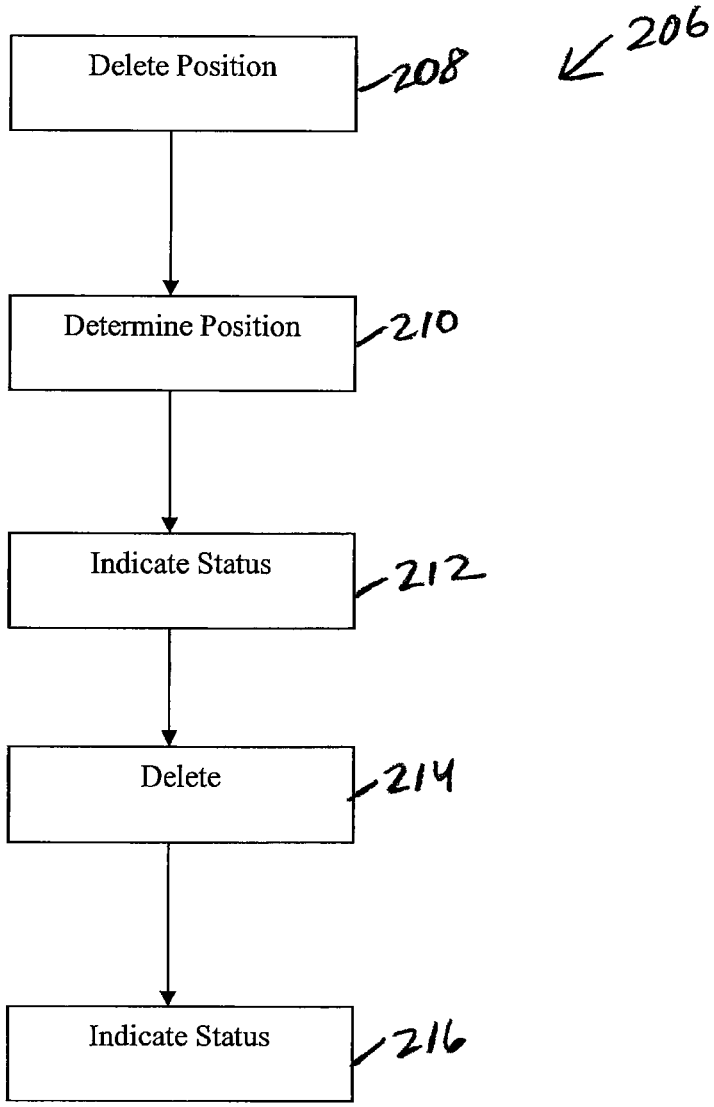
FIG. 22 is a flow diagram illustrating a method of deleting authorizations in accordance with an embodiment.

Electronic keys 34 may be disassociated with the lock 10 (i.e., user identification information/unlock codes associated with the electronic keys 34 may be deleted from the memory 114 of the lock 12) in accordance with an embodiment as follows. Operation 206 shown in FIG. 22 enables electronic keys 34 to be disassociated with the lock 10 in accordance with an embodiment. The operation 206 may start in procedure 208 wherein the master user 48 rotates the mechanical key 35 in the mechanical lock 11 to the Delete position (see FIG. 12). The operation 206 may then proceed to procedure 210, wherein the encoder 92 outputs signals to the controller 40 indicating the movement of the mechanical lock 11 and the mechanical key 35 to the Delete position. The operation 206 proceeds to procedure 212 wherein the controller 40 controls the lock 10 to output a warning indication for a predetermined duration by emitting tones having an increased frequency using the buzzer 112, blinking the green LED light 27B at an increased rate, and blinking the red LED light 27A at an increased rate. If the position of the mechanical key 35 is not changed during this procedure 212, then the operation 206 proceeds to procedure 214 wherein the user identification information/unlock codes in the memory 114 are deleted. The operation 206 then proceeds to procedure 216 wherein the lock 10 indicates that 1) the deletion was successful by emitting a single tone using the buzzer 112 and blinking the green LED light 27B once or 2) that the deletion was unsuccessful by emitting high frequency tones using the buzzer 112 and blinking the red LED light 27A at a fast rate. In this deletion mode, it is contemplated that the lock 10 may ignore any other triggers or actions that the master user 48 attempts to perform on the lock 10 (e.g., inserting an electronic key 34, plugging a USB cable into the USB port 28). It is contemplated that if the mechanical key 35 is rotated during procedure 212, the deletion process may cease and the lock 10 may go into a standby mode.

It should be appreciated that the above described examples of the lock 10 are not intended to be limiting. As mentioned above, it should be appreciated that the first and stop members 20, 24 may be located at other locations on the lock 10. Just for example, in one embodiment, the first stop member 20 may be constructed and arranged to selectively prevent the first leg 16 out of the lock housing 12, and the second stop member 24 may be constructed and arranged to selectively prevent the second leg 18 out of the lock housing 12, or vice versa.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electronic and manual lock assembly comprising:

a lock housing;

a mechanical lock carried by the lock housing;

an electric motor carried by the lock housing;

a shackle having a pair of legs, the shackle configured to be unlocked relative to the lock housing by having one of the legs pivotally connected with the lock housing and the other of the legs rotated out of the lock housing;

a first stop member operable to prevent one of the legs from being rotated out of the lock housing through a first side opening in the lock housing, the first stop member being moveable as a result of unlocking the mechanical lock to enable one of the legs to be rotated out of the lock housing; and a second stop member operable to prevent one of the legs from being rotated out of the lock housing through a second side opening in the lock housing, the second stop member being moveable as a result of operating the electric motor to enable one of the legs to be rotated out of the lock housing;

wherein the first stop member and the second stop member being independently moveable by the mechanical lock and the electric motor respectively.

2. The lock of claim 1, wherein the first stop member is a slideable panel located on one side of the lock housing such that in the unlocked position, a second leg of the pair of the legs is rotatable out of the lock housing in a first direction.

3. The lock of claim 2, wherein the second stop member is a slideable panel located on another side of the lock housing such that in the unlocked position, the second leg of the pair of the legs is rotatable out of the lock housing in a second direction.

4. The lock of claim 1, wherein the mechanical lock comprises a key cylinder.

5. The lock of claim 1, wherein the mechanical lock comprises a combination lock.

6. The lock of claim 1, further comprising a controller constructed and arranged to be in communication with the motor.

7. The lock of claim 6, wherein the controller comprises a radio frequency receiver configured to receive signals comprising an unlock code from an electronic key.

8. The lock of claim 7, wherein the electronic key comprises a radio frequency transmitter configured to transmit signals comprising an unlock code.

9. The lock of claim 7, wherein the lock comprises a slot constructed and arranged to receive the electronic key.

10. The lock of claim 7, wherein the controller comprises memory configured to store unlock codes, and wherein the controller is configured to compare the unlock code received from the electronic key to the unlock codes stored in memory to determine if the unlock code received from the electronic key is an authorized unlock code.

11. The lock of claim 10, wherein the controller is constructed and arranged to enable the motor to move the second stop member to the unlocked position in response to an authorized unlock code transmitted from the electronic key.

12. The lock of claim 6, further comprising an encoder constructed and arranged to be operatively connected to a rotatable component of the mechanical lock and in communication with the controller.

13. The lock of claim 12, wherein electric signals sent by the encoder to the controller enable the controller to determine an angular position of the rotatable component of the mechanical lock.

14. The lock of claim 13, wherein the electric signals sent by the encoder to the controller in response to the angular position of the rotatable component of the mechanical lock are associated with operations that the controller is configured to perform.

15. The lock of claim 14, wherein the operations comprise adding or deleting unlock codes from memory.

16. The lock of claim 12, further comprising a guide structure constructed and arranged to connect the encoder to the rotatable component, wherein rotation of the rotatable component rotates the guide structure and the encoder.

17. The lock of claim 16, further comprising an indicator constructed and arranged to operate with the rotatable component to indicate that a selected position of the rotatable component has been reached during rotation of the mechanical lock.

18. The lock of claim 17, wherein the indicator comprises a spring loaded ball constructed and arranged to be received in a detent formed in the guide structure during rotation of the rotatable component.

19. The lock of claim 12, wherein the rotatable component comprises a key cylinder.

20. An electronic and manual lock assembly comprising:

a lock housing;

a shackle having a pair of legs, the shackle being unlockable relative to the lock housing by having at least one of the legs being moved out of the lock housing through a side opening in the lock housing;

a controller having a memory configured to store unlock codes transmitted from at least one electronic key;

an electric motor carried by the lock housing and configured to be moveable by the controller to unlock the shackle relative to the lock housing based on the unlock codes received by the controller from the at least one electronic key; and a mechanical lock carried by the lock housing and moveable by a mechanical key between a plurality of positions;

wherein movement of the mechanical lock by the mechanical key to a first position of the plurality of positions enables the controller to add unlock codes to the memory and movement of the mechanical lock by the mechanical key to a second position of the plurality of positions unlocks the shackle relative to the lock housing.

21. The lock of claim 20, wherein movement of the mechanical lock by the mechanical key to a third position of the plurality of positions enables the controller to delete unlock codes from the memory.

22. The lock of claim 21, wherein the first and third positions are different positions.

23. The lock of claim 21, wherein the first and third positions are the same positions.

24. The lock of claim 21, further comprising an encoder operatively connected to the mechanical lock such that movement of the mechanical lock by the mechanical key effects the encoder to send signals associated with the position of the mechanical lock to the controller.

25. The lock of claim 24, wherein the encoder is an incremental encoder.

26. The lock of claim 24, further comprising a guide structure that connects the mechanical lock to the encoder such that movement of the mechanical lock effects movement of the encoder.

27. The lock of claim 20, further comprising an electric motor carried by the lock housing and moveable by an electronic key configured to transmit radio frequency signals comprising unlock codes.

28. The lock of claim 27, wherein movement of the electric motor by the electronic key unlocks the shackle relative to the lock housing.

29. The lock of claim 20, wherein the mechanical lock comprises a lock cylinder.

* * * * *